US009466276B1

(12) United States Patent
Olson

(10) Patent No.: US 9,466,276 B1
(45) Date of Patent: Oct. 11, 2016

(54) STRINGED MUSICAL INSTRUMENT HAVING A RESONATOR ASSEMBLY

(71) Applicant: Steven Martin Olson, Lansing, MI (US)

(72) Inventor: Steven Martin Olson, Lansing, MI (US)

( * ) Notice: Subject to any disclaimer, the term of this patent is extended or adjusted under 35 U.S.C. 154(b) by 0 days.

(21) Appl. No.: 14/737,682

(22) Filed: Jun. 12, 2015

(51) Int. Cl.

| | |
|---|---|
| ***G10H 3/12*** | (2006.01) |
| ***G10D 3/02*** | (2006.01) |
| ***G10H 3/03*** | (2006.01) |
| ***G10H 3/14*** | (2006.01) |

(52) U.S. Cl.
CPC ..... *G10H 3/12* (2013.01); *G10D 3/02* (2013.01); *G10H 3/03* (2013.01); *G10H 3/146* (2013.01); *G10H 2220/525* (2013.01)

(58) Field of Classification Search
CPC ..... G10H 2220/525–2220/555; G10H 3/146; G10H 3/12; G10D 2220/525; G10D 3/02
USPC ..... 84/296, 731, 730
See application file for complete search history.

(56) References Cited

U.S. PATENT DOCUMENTS 1,576,981 A * 3/1926 Lange ..... G10D 1/10 84/269
1,896,484 A * 2/1933 Dopyera ..... G10D 3/02 84/296
2,029,469 A * 2/1936 Dopyera ..... G10D 3/02 84/296
2,045,265 A * 6/1936 Dopyera ..... G10D 3/02 84/267
2,139,099 A * 12/1938 Robertson ..... G10D 3/02 84/296
3,435,721 A 4/1969 Dopera
3,595,981 A * 7/1971 Hopping ..... G10H 3/185 84/726
3,931,753 A * 1/1976 Dopera ..... G10D 3/02 84/296
3,956,963 A * 5/1976 Milton ..... G10D 3/02 84/296
4,030,396 A * 6/1977 Mariner ..... G10H 3/181 310/321
4,068,553 A * 1/1978 Dopyera ..... G10D 3/06 84/267
4,168,647 A * 9/1979 Petillo ..... G10H 3/181 84/114
4,172,404 A * 10/1979 Dopyera ..... G10D 3/06 84/291
4,211,139 A * 7/1980 Murakami ..... G10H 3/185 84/731
4,218,951 A * 8/1980 Tressel ..... G10D 3/02 84/294

(Continued)

OTHER PUBLICATIONS

Resophonic and National Biscuit Installation Guide, Fishman Website, Web page <http://www.fishman.com/files/classic_series_resophonic_installation_guide.PDF>, 3 pages, dated Jun. 15, 2013, retrieved from Internet Archive Wayback Machine <https://web.archive.org/web/20130615035227/http://www.fishman.com/files/classic_series_resophonic_installation_guide.PDF> on Oct. 21, 2015.

(Continued)

*Primary Examiner* — David Warren
(74) *Attorney, Agent, or Firm* — The Law Office of Patrick F. O'Reilly III, LLC

(57) ABSTRACT

A stringed musical instrument having a resonator assembly is disclosed herein. The stringed musical instrument includes a musical instrument body; a neck having a first end portion and a second end portion, the second end portion of the neck being coupled to the musical instrument body; a plurality of strings extending from the first end portion of the neck to the musical instrument body; and a resonator assembly disposed in the musical instrument body, the resonator assembly including a resonator diaphragm and a pickup subassembly operatively coupled to the resonator diaphragm. The pickup subassembly includes a pickup body portion and an elongate piezo-film portion operatively coupled to the pickup body portion. In one or more embodiments, a first end of the elongate piezo-film portion is attached to the pickup body portion and a second end of the elongate piezo-film portion is attached to a side of the resonator diaphragm.

20 Claims, 19 Drawing Sheets

(56) References Cited

U.S. PATENT DOCUMENTS

| | | | | |
|---|---|---|---|---|
| 4,450,748 | A | 5/1984 | Shaw et al. | |
| 4,464,967 | A | 8/1984 | Trimborn | |
| 4,823,668 | A * | 4/1989 | Marrs | G10D 3/02 84/173 |
| 4,915,009 | A * | 4/1990 | Kunstadt | G10H 3/18 84/291 |
| 4,989,491 | A * | 2/1991 | Baggs | G10D 3/02 84/723 |
| 5,056,400 | A | 10/1991 | Wachi et al. | |
| 5,078,041 | A * | 1/1992 | Schmued | G10H 3/185 84/731 |
| 5,212,336 | A * | 5/1993 | Barcus | G10H 3/146 84/192 |
| 5,218,159 | A * | 6/1993 | McClish | G10H 3/185 84/731 |
| 5,567,896 | A * | 10/1996 | Gottschall | G10D 3/02 84/294 |
| 5,602,354 | A * | 2/1997 | Martin | G10D 13/06 84/410 |
| 5,661,252 | A * | 8/1997 | Krawczak | G10D 3/06 84/291 |
| 5,723,804 | A * | 3/1998 | Replogle | G10H 3/18 84/726 |
| 5,780,758 | A * | 7/1998 | McGill | G10D 3/02 84/296 |
| 5,990,410 | A * | 11/1999 | Johnson | G10D 1/02 84/275 |
| 6,075,198 | A * | 6/2000 | Grant | G10H 3/181 84/291 |
| 6,191,350 | B1 * | 2/2001 | Okulov | G10H 1/0008 84/646 |
| 6,274,801 | B1 * | 8/2001 | Wardley | G10H 3/146 84/275 |
| 6,605,771 | B1 * | 8/2003 | Baggs | G10H 3/146 84/723 |
| 6,723,908 | B2 | 4/2004 | Chapman et al. | |
| 6,861,581 | B2 | 3/2005 | Geiger | |
| 7,151,210 | B2 | 12/2006 | Janes et al. | |
| 7,259,308 | B2 | 8/2007 | Geiger | |
| 7,863,507 | B2 | 1/2011 | Ayers | |
| 8,088,988 | B2 * | 1/2012 | Randazzo | G10H 3/143 84/723 |
| 8,247,678 | B1 * | 8/2012 | Ivy | G10D 3/00 84/291 |
| 8,278,538 | B1 | 10/2012 | D'Anda et al. | |
| 8,772,613 | B2 | 7/2014 | Gembar | |
| 8,822,805 | B2 * | 9/2014 | Miniaev | G10H 1/32 84/730 |
| 2004/0134332 | A1 * | 7/2004 | Kamijima | G10H 3/146 84/411 R |
| 2006/0219093 | A1 * | 10/2006 | Urbanski | G10H 3/185 84/731 |
| 2006/0243121 | A1 * | 11/2006 | Takabayashi | G10H 3/185 84/731 |
| 2007/0245884 | A1 * | 10/2007 | Yamaya | G10H 1/32 84/731 |
| 2008/0028911 | A1 | 2/2008 | DiSanto | |
| 2008/0098877 | A1 * | 5/2008 | Lewry | G10H 1/32 84/731 |
| 2008/0105101 | A1 * | 5/2008 | Eldring | G10D 1/085 84/291 |
| 2008/0223192 | A1 * | 9/2008 | Linden | G10D 3/02 84/296 |
| 2010/0101396 | A1 * | 4/2010 | Ayers | G10D 3/02 84/294 |
| 2010/0307313 | A1 * | 12/2010 | Zoran | G10D 1/085 84/192 |
| 2012/0024129 | A1 | 2/2012 | Ball et al. | |
| 2012/0234153 | A1 * | 9/2012 | D'Anda | G10D 3/02 84/294 |
| 2013/0276622 | A1 * | 10/2013 | Bartig | G10H 3/181 84/731 |
| 2014/0013930 | A1 * | 1/2014 | Dahl | G10H 3/143 84/730 |
| 2014/0260922 | A1 * | 9/2014 | Jennings | G10H 3/143 84/731 |

OTHER PUBLICATIONS

Mottola, RM, "Constructing an Under Saddle Transducer", originally published in American Lutherie #68, Winter 2001, 9 pages, retrieved from <http://www.liutaiomottola.com/PrevPubs/Piezo/CoaxTransducer.htm> on Oct. 21, 2015.

"How to install the sound well, cone and bridge", Gallardo Sound Website, Web page <http://gallardosound.wordpress.com/diyffs-instruments/resonator-guitar-finished/resonator-guitar-part-13-how-to-install-the-sound-well-cone-and-bridge/>, 2 pages, dated May 3, 2013, retrieved from Internet Archive Wayback Machine <https://web.archive.org/web/20130503154734/http://gallardosound.wordpress.com/diyffs-instruments/resonator-guitar-finished/resonator-guitar-part-13-how-to-install-the-sound-well-cone-and-bridge/> on Oct. 21, 2015.

Highlander IP-1X Inline Pickup and Preamp for Single Cone National Style Guitars, Highlander Website, Web page <http://www.highlanderpickups.com/catalog/inline.htm>, 2 pages, dated Aug. 31, 2005, retrieved from Internet Archive Wayback Machine <https://web.archive.org/web/20050831201751/http://www.highlanderpickups.com/catalog/inline.htm> on Oct. 21, 2015.

* cited by examiner

STRINGED MUSICAL INSTRUMENT HAVING A RESONATOR ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a stringed musical instrument. More particularly, the invention relates to a stringed musical instrument having a resonator assembly disposed in the body portion of the musical instrument.

2. Background

Conventional resonator-type stringed musical instruments, such as conventional resonator guitars, are often unable to accurately reproduce the sound produced by the diaphragm provided therein. Also, these conventional resonator-type stringed musical instruments are frequently subject to substantial feedback problems, particularly when they are played at higher volumes.

Therefore, what is needed is a stringed musical instrument with a resonator assembly that is capable of accurately reproducing the sound generated by the resonator diaphragm of the resonator assembly. In addition, a stringed musical instrument with a resonator assembly is needed that substantially reduces the feedback problems that are commonly associated with conventional resonator-type stringed musical instruments.

BRIEF SUMMARY OF EMBODIMENTS OF THE INVENTION

Accordingly, the present invention is directed to a stringed musical instrument having a resonator assembly that substantially obviates one or more problems resulting from the limitations and deficiencies of the related art.

In accordance with one or more embodiments of the present invention, there is provided a stringed musical instrument that includes a musical instrument body; a neck having a first end portion and a second end portion, the second end portion of the neck being coupled to the musical instrument body; a plurality of strings extending from the first end portion of the neck to the musical instrument body; and a resonator assembly disposed in the musical instrument body, the resonator assembly including a resonator diaphragm and a pickup subassembly operatively coupled to the resonator diaphragm, the pickup subassembly comprising a pickup body portion and an elongate piezo-film portion operatively coupled to the pickup body portion, the elongate piezo-film portion having a first end and a second end, the first end of the elongate piezo-film portion being attached to the pickup body portion and the second end of the elongate piezo-film portion being attached to a side of the resonator diaphragm.

In a further embodiment of the present invention, the resonator diaphragm comprises a frustoconical body portion having a tapered sidewall; and wherein the side of the resonator diaphragm to which the second end of the elongate piezo-film portion is attached comprises the tapered sidewall of the frustoconical body portion.

In yet a further embodiment, the elongate piezo-film portion is attached to the tapered sidewall of the frustoconical body portion of the resonator diaphragm by means of metallic tape.

In still a further embodiment, the frustoconical body portion of the resonator diaphragm is formed from aluminum.

In yet a further embodiment, the musical instrument body comprises at least one solid body portion having a plurality of recesses formed therein for receiving internal components of the stringed musical instrument, at least one of the plurality of recesses formed in the at least one solid body portion being configured to receive the resonator diaphragm.

In still a further embodiment, the at least one solid body portion of the musical instrument body comprises a first solid body portion forming a top portion of the musical instrument body and a second solid body portion forming a bottom portion of the musical instrument body, the first and second solid body portions of the musical instrument body configured to be attached to one another by means of a plurality of fasteners, and the first and second solid body portions together forming a resonance chamber for housing the resonator diaphragm.

In yet a further embodiment, the second solid body portion, which forms the bottom portion of the musical instrument body, comprises one or more elongate sound ports disposed therein for allowing sound generated within the resonance chamber of the musical instrument body to be discharged from the stringed musical instrument.

In still a further embodiment, the musical instrument body comprises a top cover portion, the top cover portion configured to fit over the first solid body portion and the second solid body portion.

In accordance with one or more other embodiments of the present invention, there is provided a stringed musical instrument that includes a musical instrument body; a neck having a first end portion and a second end portion, the second end portion of the neck being coupled to the musical instrument body; a plurality of strings extending from the first end portion of the neck to the musical instrument body; and a resonator assembly disposed in the musical instrument body, the resonator assembly including a resonator diaphragm and a pickup subassembly operatively coupled to the resonator diaphragm, the pickup subassembly comprising a pickup body portion and a piezo-film portion operatively coupled to the pickup body portion, a part of the piezo-film portion being attached to a side of the resonator diaphragm by means of adhesive tape.

In a further embodiment of the present invention, the pickup body portion is circular in shape, and wherein the stringed musical instrument further comprises a saddle member attached to a top portion of the pickup body portion, the saddle member extending transversely across the top portion of the pickup body portion.

In accordance with yet one or more other embodiments of the present invention, there is provided a stringed musical instrument that includes a musical instrument body, the musical instrument body including at least one solid body portion, the at least one solid body portion comprising a resonator diaphragm recess and one or more sound ports formed therein, the one or more sound ports being connected to, and extending radially from the resonator diaphragm recess; a neck having a first end portion and a second end portion, the second end portion of the neck being coupled to the musical instrument body; a plurality of strings extending from the first end portion of the neck to the musical instrument body; and a resonator assembly disposed in the musical instrument body, the resonator assembly including a resonator diaphragm and a pickup subassembly operatively coupled to the resonator diaphragm, at least a portion of the resonator diaphragm being received within the resonator diaphragm recess in the at least one solid body portion so that sound generated by resonator assembly is capable of being radially discharged through the one or more sound ports towards an ear of a person playing the stringed musical instrument.

In a further embodiment of the present invention, the musical instrument body further comprises a top cover portion, the top cover portion configured to fit over the at least one solid body portion of the musical instrument body, the top cover portion comprising one or more sound ports formed therethrough, at least one of the one or more sound ports of the top cover portion being substantially aligned with the one or more sound ports of the at least one solid body portion.

In yet a further embodiment, the at least one solid body portion of the musical instrument body comprises a first solid body portion forming a top portion of the musical instrument body and a second solid body portion forming a bottom portion of the musical instrument body, the first and second solid body portions together forming a resonance chamber for housing the resonator diaphragm, the resonator diaphragm recess and the one or more sound ports being formed in the first solid body portion of the musical instrument body, and the resonator diaphragm recess in the first solid body portion forming a portion of the resonance chamber.

In still a further embodiment, the second solid body portion, which forms the bottom portion of the musical instrument body, comprises one or more elongate sound ports disposed therein for allowing sound generated within the resonance chamber of the musical instrument body to be discharged through a back side of the stringed musical instrument.

In yet a further embodiment, the resonator diaphragm is not affixed to the first solid body portion or to the second solid body portion, the resonator diaphragm being held in place within the resonance chamber only by means of string tension applied by one or more of the plurality of strings of the stringed musical instrument.

In still a further embodiment, the pickup subassembly comprises a pickup body portion and an elongate piezo-film portion operatively coupled to the pickup body portion, the elongate piezo-film portion having a first end and a second end, the first end of the elongate piezo-film portion being attached to the pickup body portion and the second end of the elongate piezo-film portion being attached to a side of the resonator diaphragm.

In yet a further embodiment, the resonator diaphragm comprises a frustoconical body portion having a tapered sidewall; and wherein the side of the resonator diaphragm to which the second end of the elongate piezo-film portion is attached comprises the tapered sidewall of the frustoconical body portion.

In still a further embodiment, the frustoconical body portion of the resonator diaphragm is formed from aluminum.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
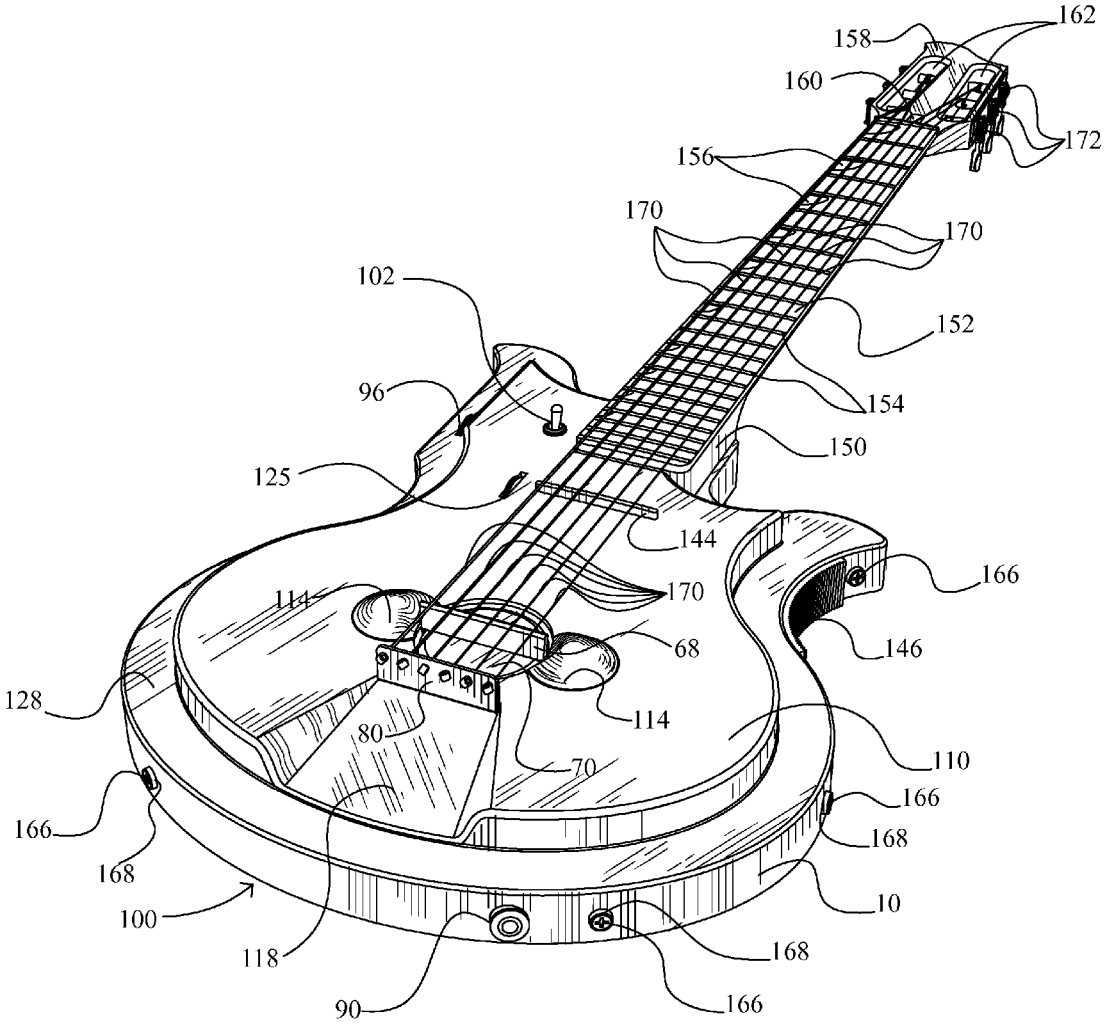
FIG. 1 is an overall perspective view of a stringed musical instrument with a resonator assembly, according to an embodiment of the invention.
Figure 2:
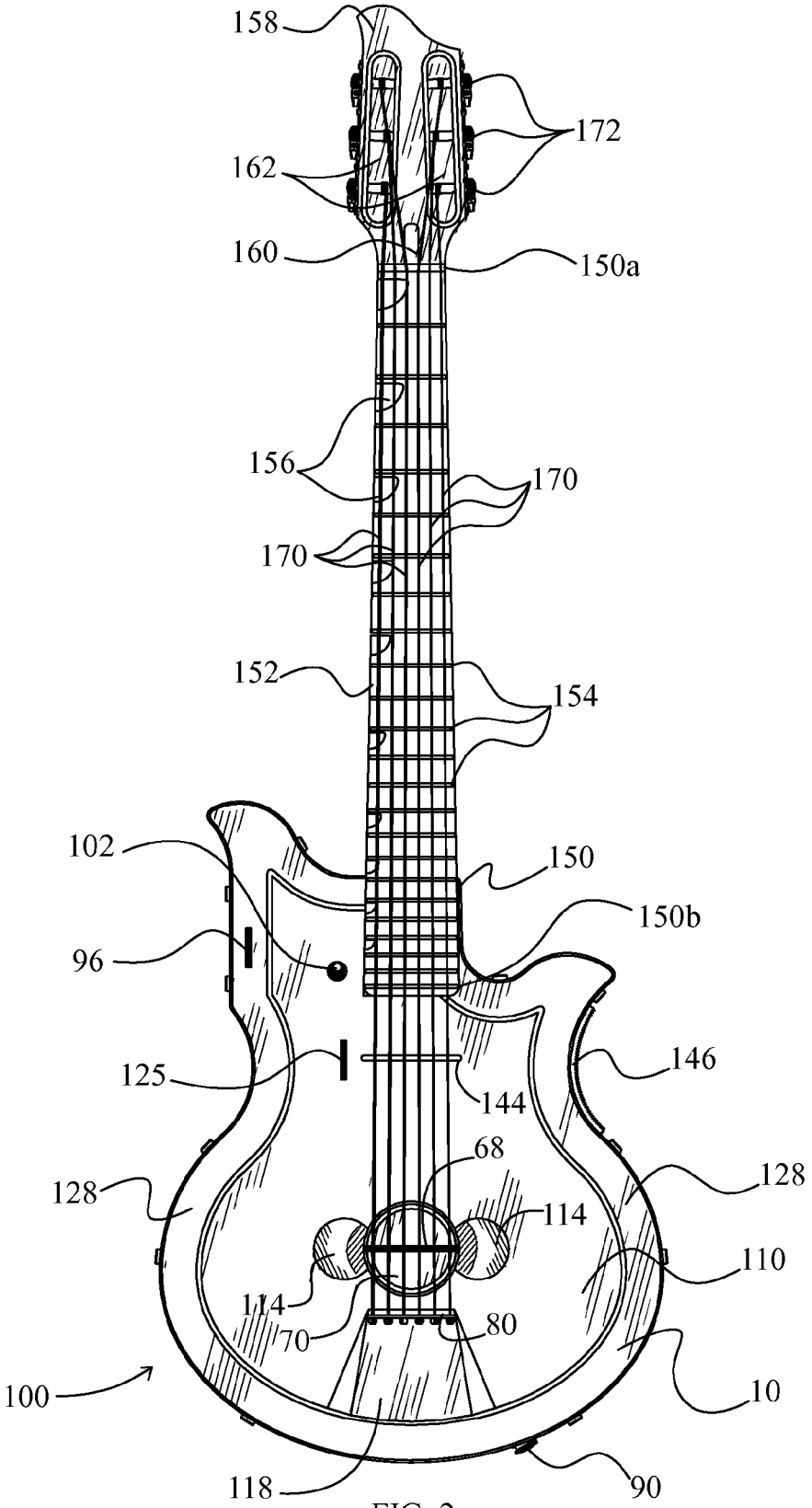
FIG. 2 is a top view of the stringed musical instrument of FIG. 1.
Figure 3:
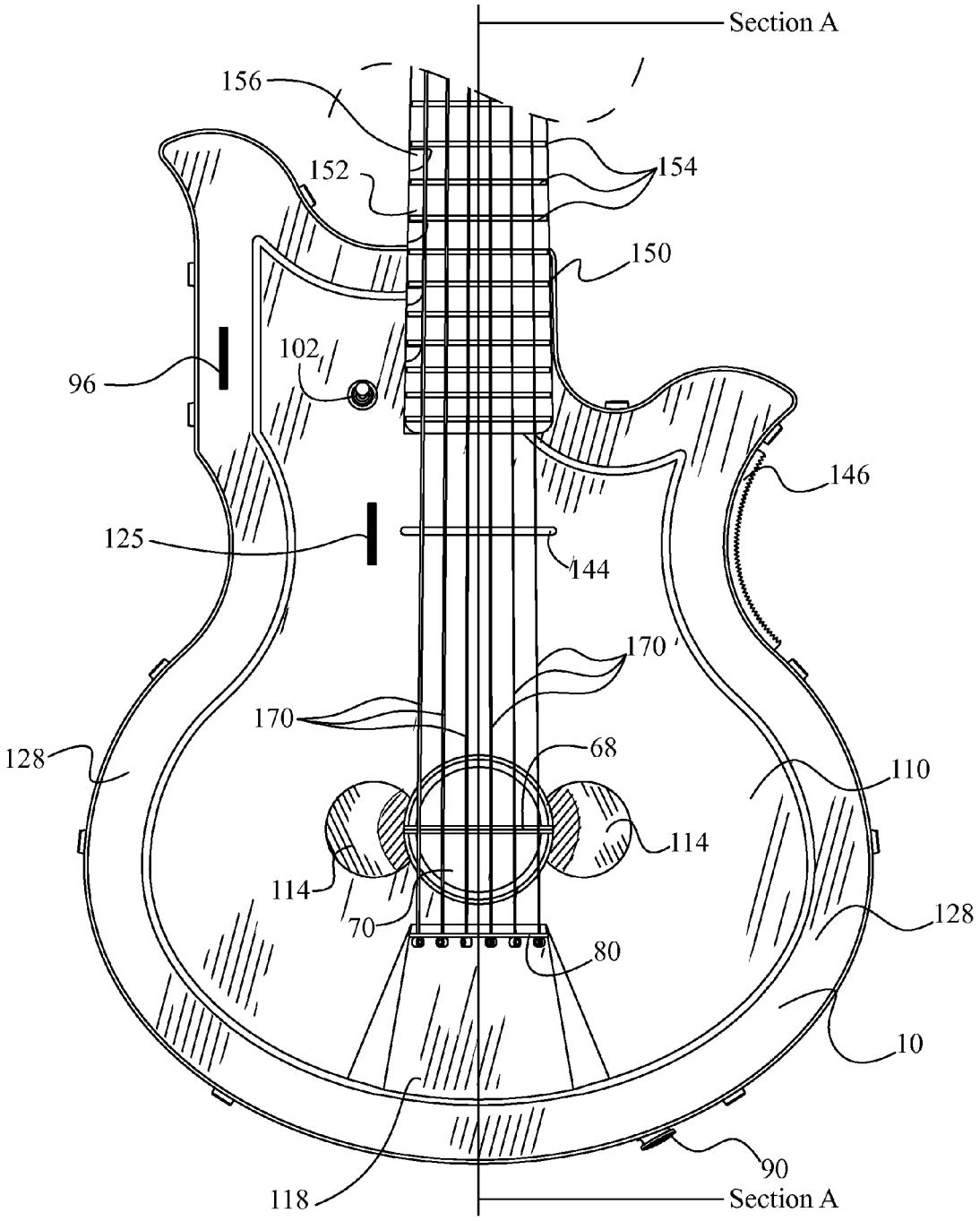
FIG. 3 is an enlarged top view of the body portion of the stringed musical instrument illustrated in FIG. 1.
Figure 4:
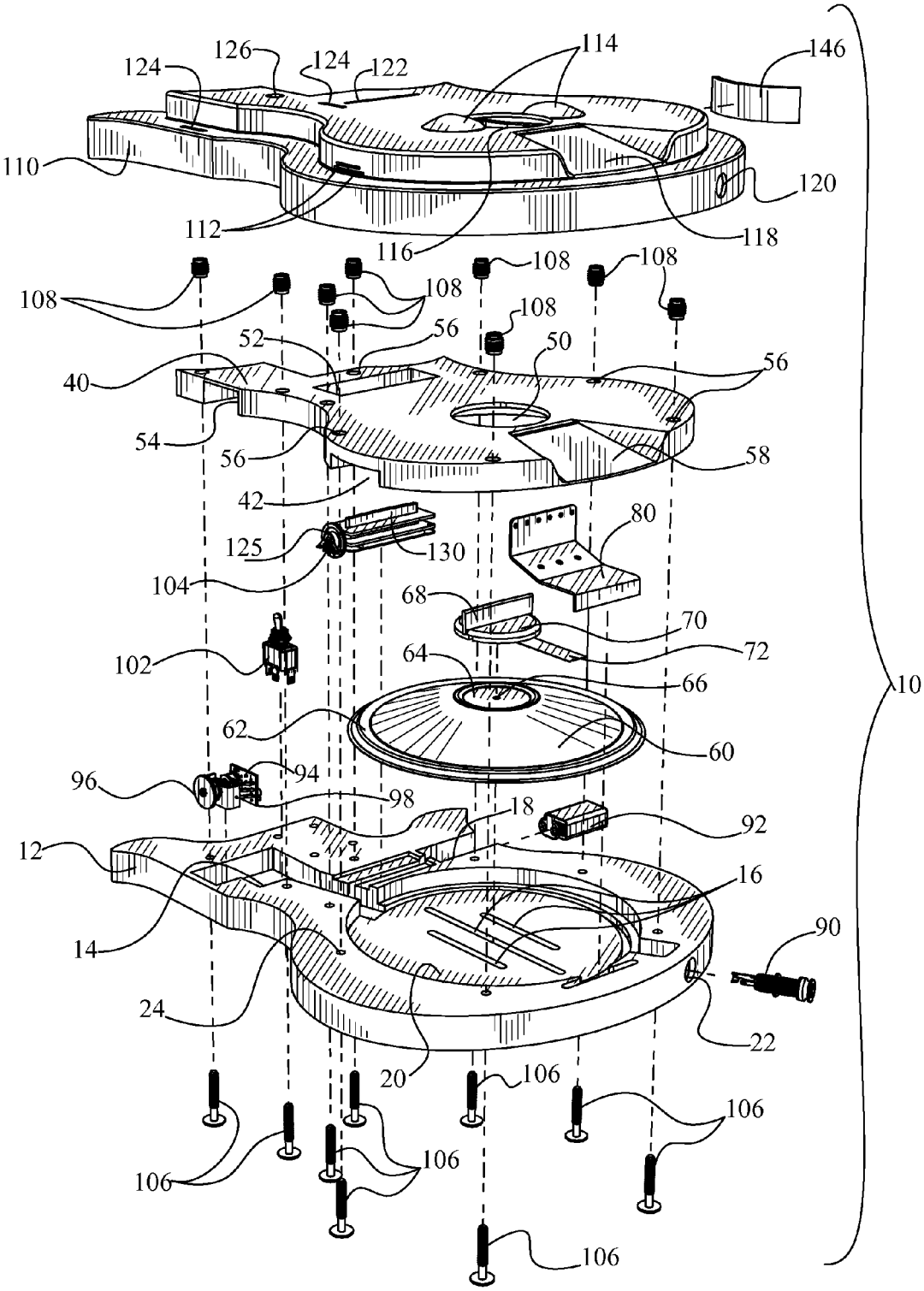
FIG. 4 is an exploded perspective view of the body portion of the stringed musical instrument of FIG. 1.
Figure 18:
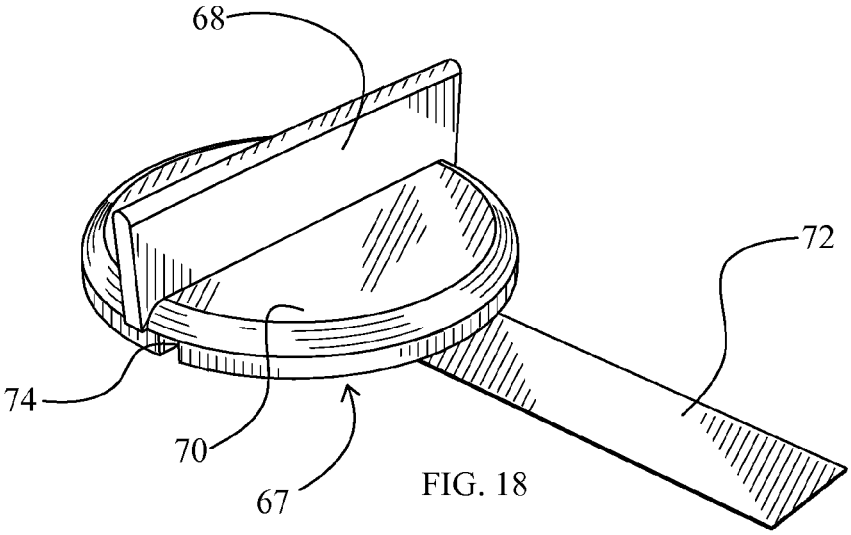
FIG. 18 is a perspective view of a pickup subassembly of the resonator assembly of the stringed musical instrument illustrated in FIG. 1.
Figure 28:
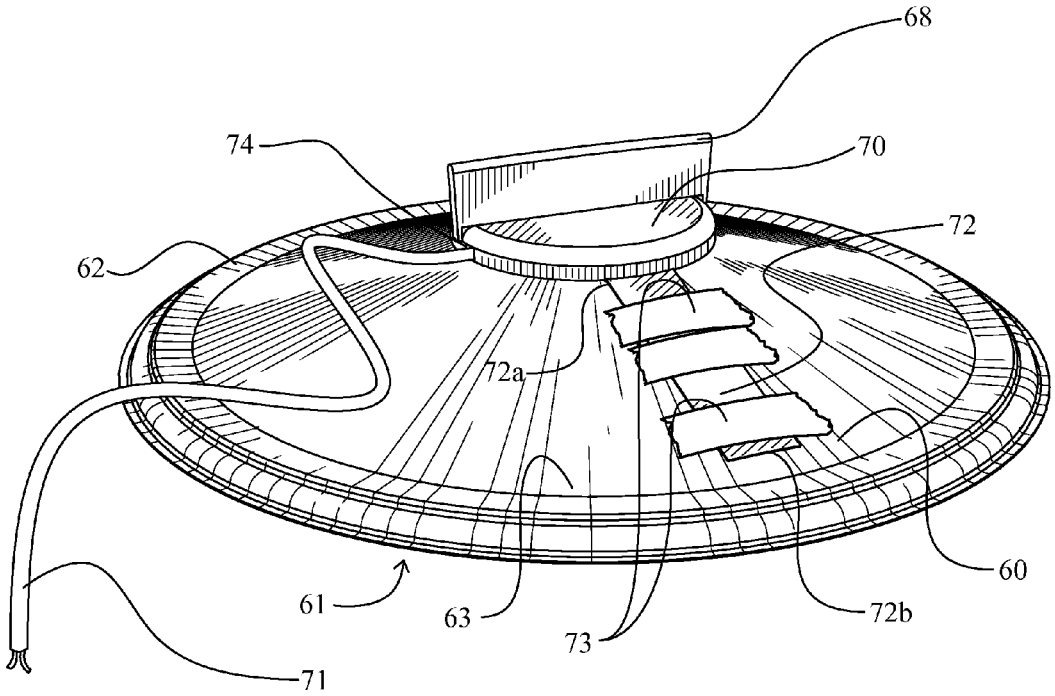
FIG. 28 is a perspective view of the resonator assembly of the stringed musical instrument illustrated in FIG. 1.

An illustrative embodiment of a stringed musical instrument with a resonator assembly is seen generally at 100 in FIGS. 1 and 2. As illustrated in these figures, the stringed musical instrument 100 generally comprises a musical instrument body 10; a neck 150 having a first end portion 150*a* and a second end portion 150*b*, the second end portion 150*b* of the neck 150 being coupled to the musical instrument body 10; a plurality of strings 170 extending from the first end portion 150*a* of the neck 150 to the musical instrument body 10; and a resonator assembly 61 disposed in the musical instrument body 10 (see FIGS. 4, 5, and 28). Referring to FIGS. 4, 18, and 28, it can be seen that the resonator assembly 61 generally includes a resonator diaphragm 60 and a pickup subassembly 67 operatively coupled to the resonator diaphragm 60. As best shown in FIGS. 18-20 and 28, the pickup subassembly 67 of the resonator assembly 61 comprises a pickup body portion 70 and an elongate piezo-film portion 72 operatively coupled to the pickup body portion 70. The elongate piezo-film portion 72 of the pickup subassembly 67 has a first end 72*a* and a second end 72*b* (refer to FIG. 28). The first end 72*a* of the elongate piezo-film portion 72 is attached to the pickup body portion 70 and the second end 72*b* of the elongate piezo-film portion 72 is attached to a side of the resonator diaphragm 60 (see FIG. 28).

Figure 15:
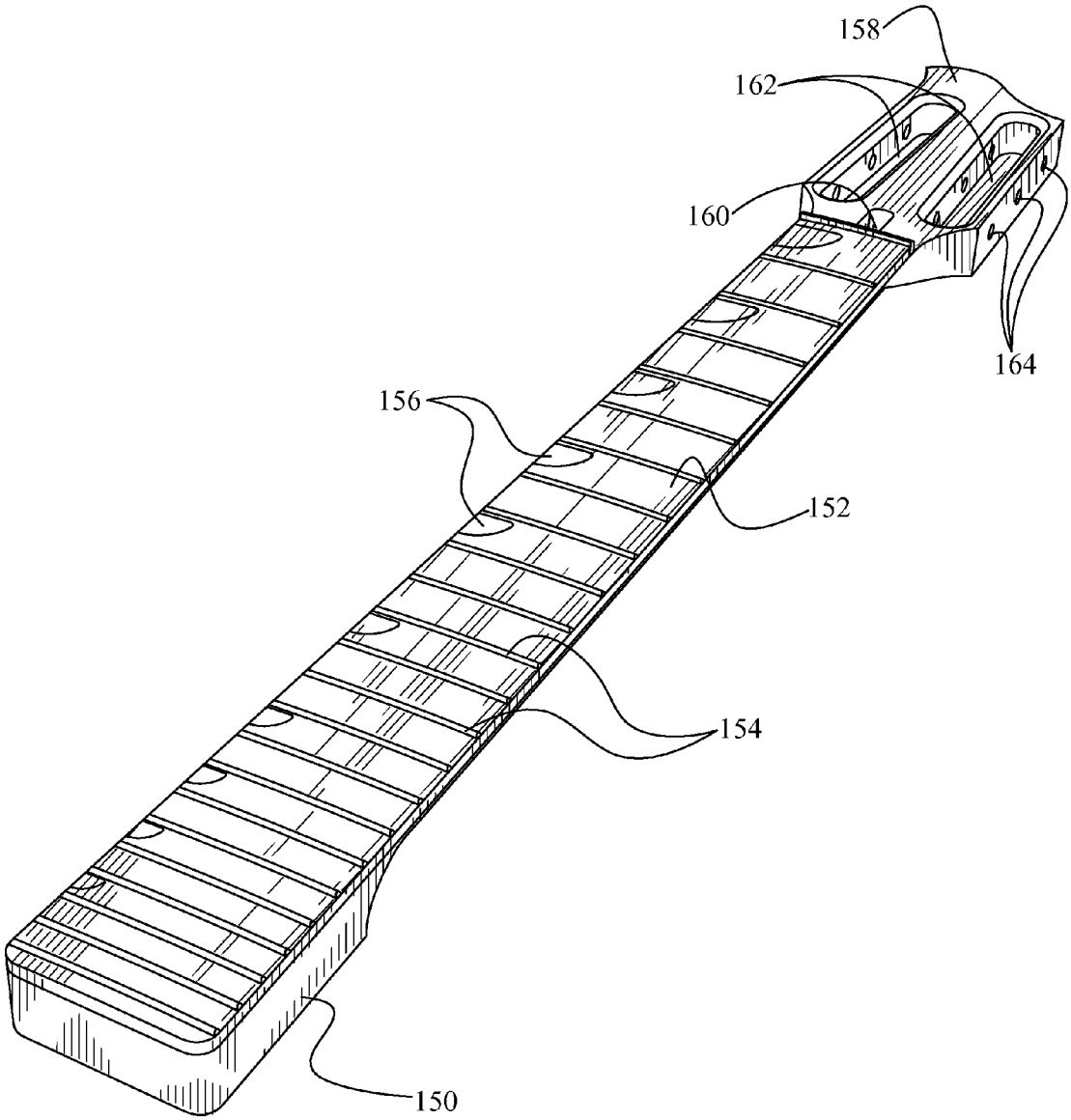
FIG. 15 is a perspective view of a neck portion of the stringed musical instrument illustrated in FIG. 1, wherein the strings and the tuning pegs of the neck portion have been removed.
Figure 16:
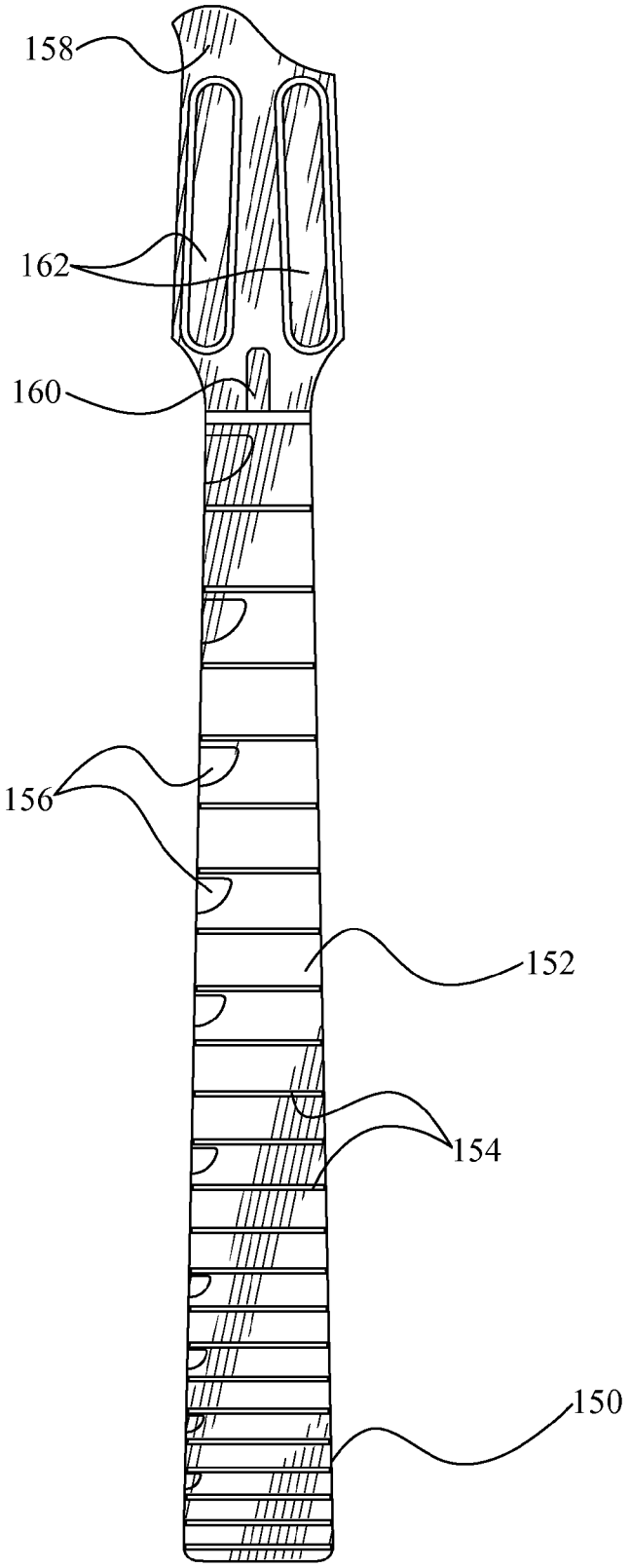
FIG. 16 is a top view of the neck portion of the stringed musical instrument illustrated in FIG. 1, wherein the strings and the tuning pegs of the neck portion have been removed.
Figure 17:
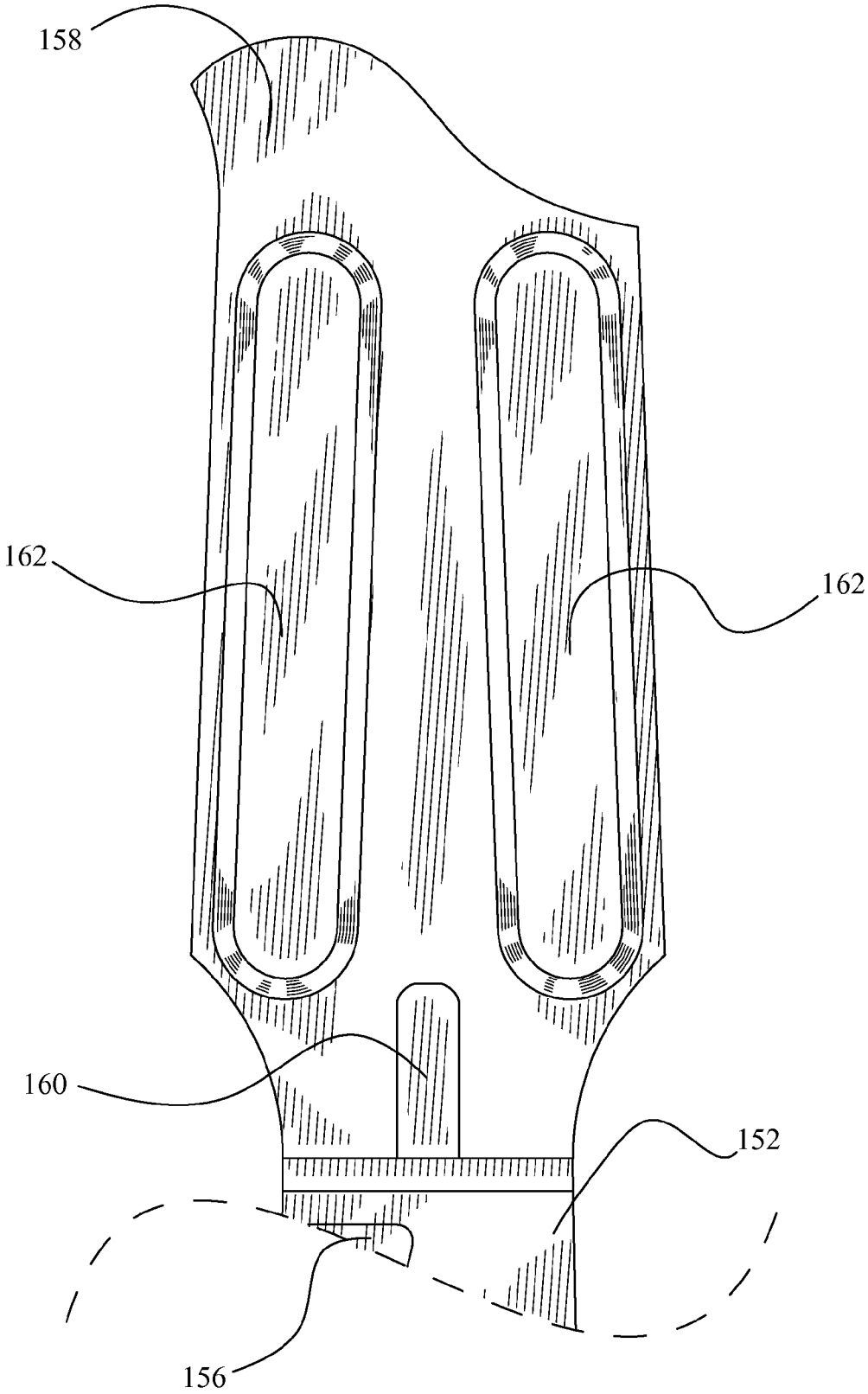
FIG. 17 is an enlarged top view of a headstock of the neck portion of the stringed musical instrument illustrated in FIG. 1.

Referring to FIGS. 1, 2, 15, and 16, it can be seen that the neck 150 of the stringed musical instrument 100 comprises a fretboard 152 with a plurality of frets 154 spaced apart along the length thereof. In their relaxed state, the strings 170 of the stringed musical instrument 100 are disposed slightly above the upper surface of the fretboard 152. Also, as best shown in FIGS. 15 and 16, the fretboard 152 of the musical instrument neck 150 includes a plurality of position marker inlays 156 spaced apart along the length thereof for providing reference points for the player as to the harmonic intervals of the strings 170. In addition, as illustrated in FIGS. 1, 2, 15, and 16, a headstock 158 is located at the first end portion 150*a* of the neck 150. The headstock 158 comprises an access notch 160 for gaining access to the truss rod nut when required for servicing or adjustment, and two elongate recesses 162 extending in a lengthwise direction thereof (refer to the enlarged top view of FIG. 17). Also, as shown in FIGS. 1 and 2, the headstock 158 comprises a plurality of tuning pegs 172 (i.e., six (6) tuning pegs 172) that enable the tension of the strings 170 to be adjusted, which in turn, alters the pitch of the strings 170. Each of the tuning pegs 172 is received within a respective tuning peg aperture 164 transversely disposed through one of the two opposed sides of the headstock 158 (refer to FIG. 15). In FIGS. 1 and 2, it can be seen that one end of each string 170 of the musical instrument 100 is fixedly attached to the body 10 at a tailpiece member 80, while the other, opposite end of each string 170 is adjustably attached to a respective tuning peg 172 of the headstock 158. In addition, as depicted in the sectional view of FIG. 5, the neck 150 of the stringed musical instrument 100 further comprises a truss rod 176 extending along the length thereof. In one or more embodiments, the truss rod 176 adjusts the lengthwise curvature of the neck 150. Referring again to FIG. 5, it can be seen that the truss rod 176 is provided with a truss rod anchor 174 in the location where the neck 150 is mounted to the body portion 10 of the stringed musical instrument 100. The truss rod anchor 174 secures one end of the adjustable truss rod 176 so that when tension is applied to the opposite end, the truss rod bows inside the truss rod cavity to straighten the neck 150 of the stringed musical instrument 100.

In an exemplary embodiment, each of the plurality of strings 170 of the musical instrument 100 may be formed from a suitable metallic material, such as nickel.

Figure 21:
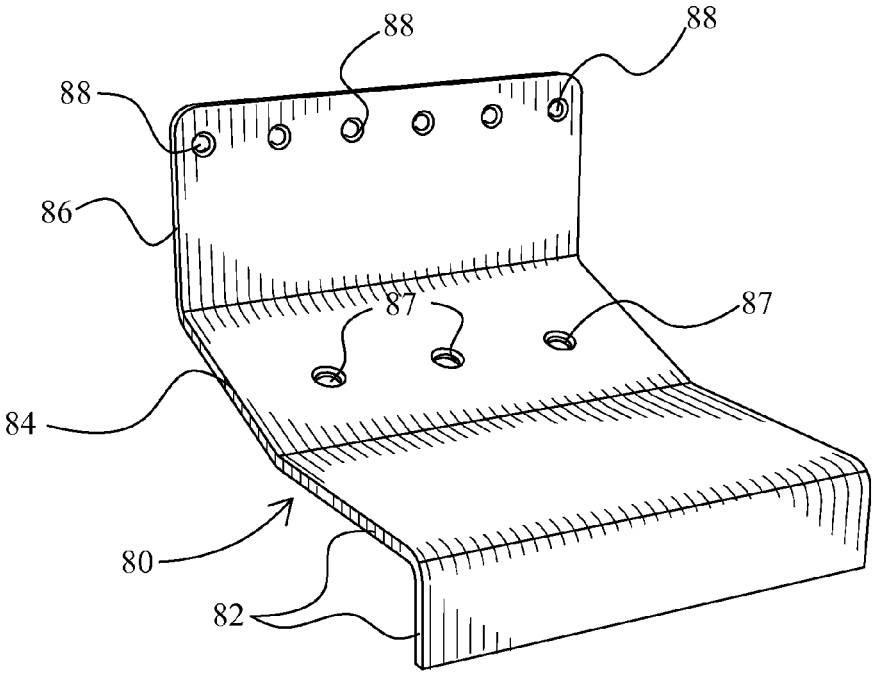
FIG. 21 is a perspective view of a tailpiece component of the stringed musical instrument illustrated in FIG. 1.
Figure 22:
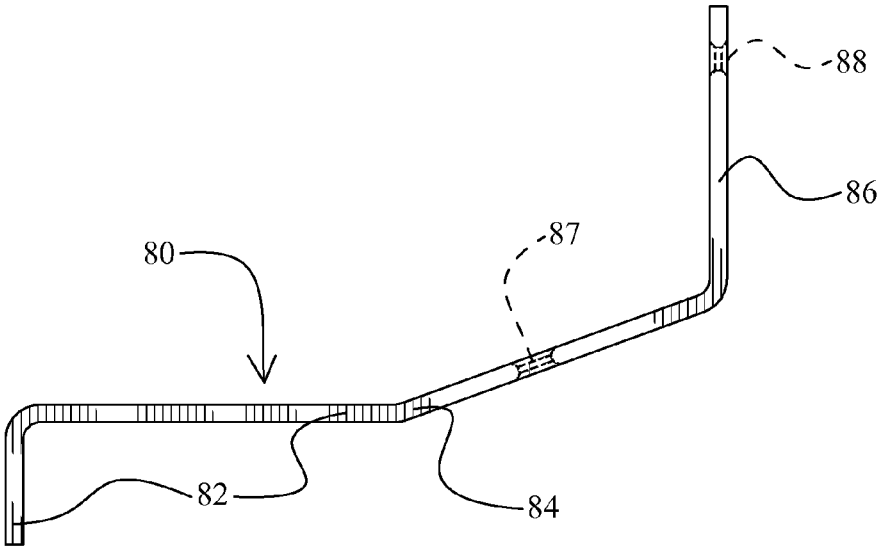
FIG. 22 is a side view of the tailpiece component of the stringed musical instrument illustrated in FIG. 1.

The details of the tailpiece member 80, which attaches the strings 170 to the instrument body portion 10, are illustrated in FIGS. 21 and 22. As shown in these figures, the tailpiece member 80 is generally in the form of a bent plate member with an L-shaped lower portion 82, a diagonal central portion 84 connected to the L-shaped lower portion 82, and an upstanding top portion 86 connected to the diagonal central portion 84. In FIGS. 21 and 22, it can be seen that the diagonal central portion 84 of the tailpiece member 80 may comprise a plurality of mounting apertures 87 (e.g., three (3) mounting apertures 87) for receiving respective fasteners to secure the tailpiece member 80 to the musical instrument body portion 10. In the illustrative embodiment, the tailpiece member 80 is affixed by screws to the underside of the top solid body portion 40 (i.e., within tailpiece recess 46), and it connects to a ground in the tailpiece mounting slot 32 of bottom solid body portion 12. Alternatively, rather than using fasteners to secure the tailpiece member 80 to the musical instrument body portion 10, the tailpiece member 80 may be affixed to the body portion 10 using a suitable adhesive or glue. When a suitable adhesive or glue is used for securing the tailpiece member 80 to the body portion 10, the mounting apertures 87 are not required to be provided in the tailpiece member 80. With reference again to FIGS. 21 and 22, it can be seen that the upstanding top portion 86 of the tailpiece member 80 comprises a plurality of string apertures 88 (e.g., six (6) string apertures 88) disposed therethrough for receiving respective strings 170 of the stringed musical instrument 100. As shown in the side view of FIG. 22, in the illustrative embodiment, each of the mounting apertures 87, and each of the string apertures 88, is in the form of a countersunk hole with countersink surfaces disposed on both opposed ends of each hole. In an exemplary embodiment, the tailpiece member 80 may be formed from brass.

Now, with reference to FIGS. 4, 18-20 and 28, the resonator assembly 61 of the stringed musical instrument 100 will be described in detail. As described above, the resonator assembly 61 generally includes a resonator diaphragm 60 and a pickup subassembly 67 operatively coupled to the resonator diaphragm 60. As shown in FIGS. 4 and 28, the resonator diaphragm 60 or resonator cone 60 comprises a frustoconical body portion having a tapered sidewall 63 and a rim 62 disposed at the base of the tapered sidewall 63. In addition, as described above, the pickup subassembly 67 of the resonator assembly 61 comprises a pickup body portion 70 and an elongate piezo-film portion 72 or piezo-ribbon portion 72 operatively coupled to the pickup body portion 70. In the illustrated embodiment of FIG. 28, it can be seen that the second end 72*b* of the elongate piezo-film portion 72 of the pickup subassembly 67 is adhered to the tapered sidewall 63 of the frustoconical body portion of the resonator diaphragm 60. In the illustrative embodiment, a distal part of the elongate piezo-film portion 72 of the pickup subassembly 67 is attached to the tapered sidewall 63 of the frustoconical body portion of the resonator diaphragm 60 by means of adhesive metallic tape pieces 73. As shown in FIG. 28, the elongate piezo-film portion 72 extends across the top surface of the tapered sidewall 63 of the resonator diaphragm 60 in a generally radial manner, and the bottom surface of the linear piezo-film portion 72 lies generally contiguous to the top surface of the tapered sidewall 63 of the resonator diaphragm 60. In an exemplary embodiment, the frustoconical resonator diaphragm 60 may be formed from aluminum or another suitable metallic material. As such, in the exemplary embodiment, the adhesive metallic tape 73 may affix the elongate piezo-film portion 72 to the surface of the aluminum resonator diaphragm 60.

Alternatively, or in addition to the tape pieces 73 illustrated in FIG. 28, the elongate piezo-film portion 72 may be secured to the tapered sidewall 63 of the resonator diaphragm 60 using double-sided adhesive tape disposed on the bottom surface of the elongate piezo-film portion 72.

Advantageously, the resonator assembly 61 includes the elongate piezo-film portion 72 or piezo electric film element 72 secured to the pickup body portion 70, and sealed onto the resonator diaphragm 60 to accurately reproduce the acoustic sound of the resonator assembly 61. Because the piezo electric film transducer element 72 is inlayed within the pickup body portion 70 and is sealed directly onto the tapered sidewall 63 of the resonator diaphragm 60, the resonator assembly 61 is capable of picking up substantially all of the harmonic overtones produced by the frustoconical resonator diaphragm 60.

Figure 19:
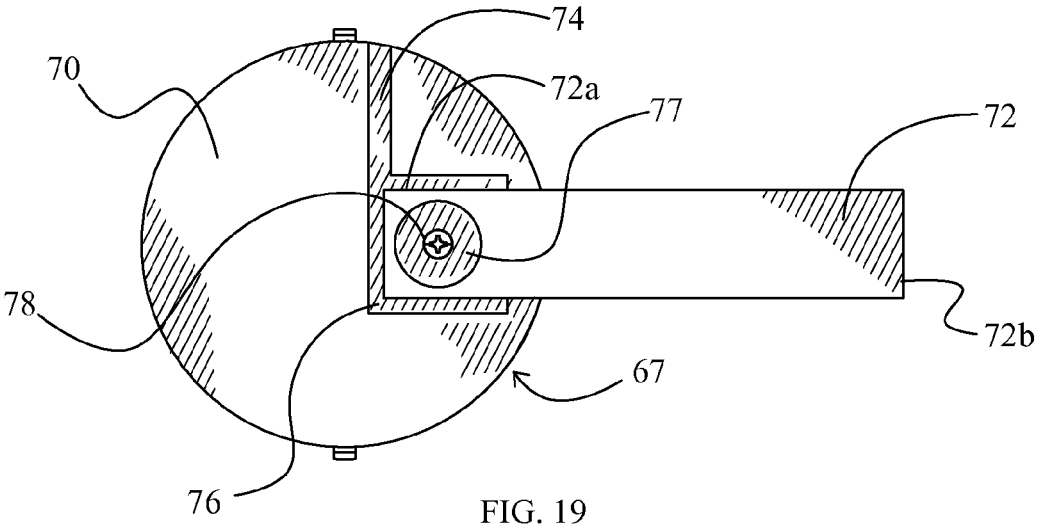
FIG. 19 is a bottom view of the pickup subassembly of the resonator assembly of the stringed musical instrument illustrated in FIG. 1.
Figure 20:
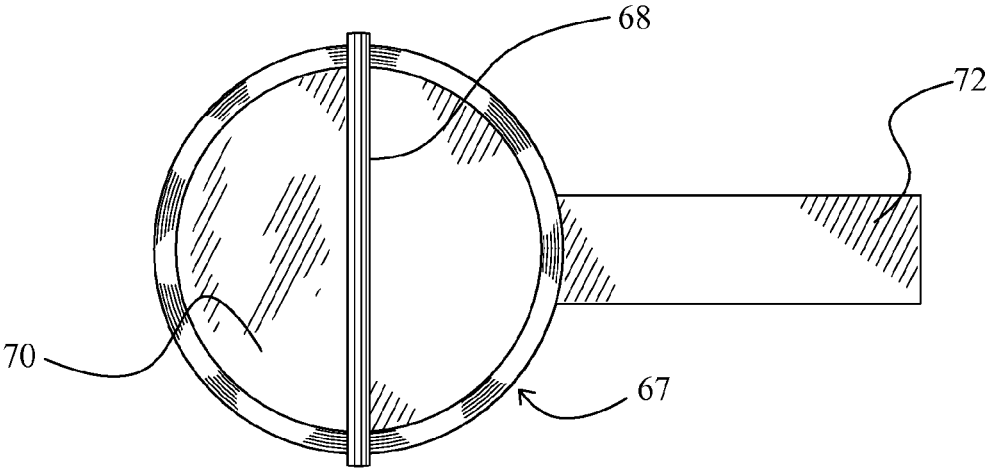
FIG. 20 is a top view of the pickup subassembly of the resonator assembly of the stringed musical instrument illustrated in FIG. 1.

With particular reference to FIGS. 18-20, the pickup subassembly 67 will be explained in more detail. Initially, referring to FIG. 18, it can be seen that the pickup body portion 70 is generally circular in shape (i.e., disk-like in shape) with a transverse recess formed in the top portion thereof for receiving a saddle member 68. The saddle member 68 is disposed within the transverse recess, and is securely attached to the top portion of the pickup body portion 70. In FIGS. 18 and 20, it can be seen that the saddle member 68 extends transversely across the top portion of the pickup body portion 70. Referring to the bottom view of FIG. 19, it can be seen that, on the opposite side of the pickup body portion 70, a rectangular or square recess 76 is formed therein for accommodating the first end 72*a* of the elongate piezo-film transducer portion 72, and an elongate recess 74 is formed therein for accommodating the wire 71 of the pickup subassembly 67 (i.e., the elongate recess 74 in the bottom surface of the pickup body portion 70 is in the form of a wire slot for receiving the pickup wire 71). The pickup wire 71 (see FIG. 28) is electrically coupled to the first end 72*a* of the elongate piezo-film portion 72. In an exemplary embodiment, the pickup wire 71 is in the form of a coaxial output wire for carrying the electrical output signal generated by the elongate piezo-film portion 72. With reference again to FIG. 19, it can be seen that the first end 72*a* of the elongate piezo-film portion 72 is secured within the recess 76 in the bottom surface of the pickup body portion 70 by means of a fastener 78 and associated washer 77. In the illustrated embodiment of FIG. 19, the fastener 78 is in the form of a screw (e.g., a wood screw), which passes through an aperture in the washer 77 and through an aperture in the first end 72*a* of the elongate piezo-film portion 72. In an exemplary embodiment, the pickup body portion 70 may comprise a biscuit-style resophonic pickup formed from a suitable wood material, such as a maple vaneer. Also, in the exemplary embodiment, the saddle member 68 may be formed from a suitable wood material, such as maple. In addition, in the exemplary embodiment, the elongate recess 74 and the rectangular or square recess 76 in the bottom surface of the pickup body portion 70 may have a depth of approximately three-sixteenths (3/16) of an inch to accommodate the first end 72*a* of the elongate piezo-film portion 72 and the associated wiring connected thereto. In one or more embodiments, the first end 72*a* of the elongate piezo-film portion 72 may also be glued in place within the recess 76 in the bottom surface of the pickup body portion 70, and then a wood strip (i.e., a Maple vaneer strip) may be placed over the outer bottom surface of the first end 72*a* so as to sandwich the first end 72*a* of the elongate piezo-film portion 72 in place within the bottom portion of the pickup body portion 70.

Turning to the exploded view of FIG. 4, the manner in which the pickup body portion 70 is attached to the resonator diaphragm 60 will be explained. As shown in this figure, the frustoconical resonator diaphragm 60 is provided with a circular central pickup recess 64 for accommodating the circular pickup body portion 70 therein. The central pickup recess 64 of the frustoconical resonator diaphragm 60 further comprises a pickup fastener aperture 66 for receiving a fastener (e.g., a screw) that secures the pickup body portion 70 to the central pickup recess 64 of the resonator diaphragm 60. Also, in one or more embodiments, in addition to the pickup body portion 70 being attached to the central pickup recess 64 of the resonator diaphragm 60 by a screw through the aperture 66, the periphery of the pickup body portion 70 may also glued to the central pickup recess 64 of the resonator diaphragm 60 using a suitable adhesive.

Next, to better illustrate the functionality of the invention, the operation of the illustrative resonator assembly 61 of the of the stringed musical instrument 100 will be explained with reference to FIGS. 1, 5, 18-20, and 28. First, when a musician plays the stringed musical instrument 100, he or she applies a vibratory load to one or more of the strings 170. In turn, the one or more strings 170 apply the vibratory load to the saddle member 68. In particular, the one or more strings 170 of the stringed musical instrument 100 generally apply a compressive force or load to the saddle member 68. After which, by virtue of being operatively connected thereto, the saddle member 68 transfers the vibratory load exerted thereon by the one or more strings 170 of the musical instrument 100 to the pickup body portion 70. Then, the vibratory load is transferred from the pickup body portion 70 to the resonator diaphragm 60, which vibrates as a result of the vibratory load acting thereon (i.e. the diaphragm 60 resonates as a result of the vibratory load applied thereto). The elongate piezo-film portion 72, which is attached to the tapered sidewall 63 of the resonator diaphragm 60, senses the vibrations imparted on the resonator diaphragm 60, and conducts an input signal to the pickup wire 71. Finally, the pickup wire 71 conveys an electrical output signal based upon the input signal from the elongate piezo-film portion 72 or piezo-film ribbon 72. The electrical output signal is then delivered to an external amplifier, and eventually speakers, so that the sound generated by the stringed musical instrument 100 can be delivered to the musician and any members of an audience that may be listening to the musician while he or she is playing the musical instrument 100.

Now, with reference to FIGS. 1-14, the construction of the illustrative musical instrument body 10 will be described in detail. In the illustrative embodiment, the musical instrument body 10 generally comprises a first solid body portion 40 forming a top portion of the musical instrument body 10, a second solid body portion 12 forming a bottom portion of the musical instrument body 10, and a top cover portion 110 that fits over the first solid body portion 40 and the second solid body portion 12. The first and second solid body portions 40, 12 together form a resonance chamber (see FIG. 5) for housing the resonator diaphragm 60. In particular, the top portion of the resonance chamber is formed by the frustoconical recess 48 in the first solid body portion 40 (see e.g., FIG. 11) and the bottom portion of the resonance chamber is formed by the generally cylindrical cavity 20 in the second solid body portion 12 (see e.g., FIG. 12). Also, as shown in the exploded view of FIG. 4, and in the sectional view of FIG. 5, the bottom solid body portion 12 is attached to the top solid body portion 40 by means of a plurality of fasteners (e.g., nine (9) pan head bolts 106 and nine (9) corresponding threaded insert members 108). In the illustrative embodiment, the external threads on each of the pan head bolts 106 threadingly engage corresponding internal threads on a respective threaded insert member 108 (e.g., see FIG. 5). In an alternative embodiment, T-head Allen screws may be used in lieu of the pan head bolts 106 to secure the bottom solid body portion 12 to the top solid body portion 40.

Figure 9:
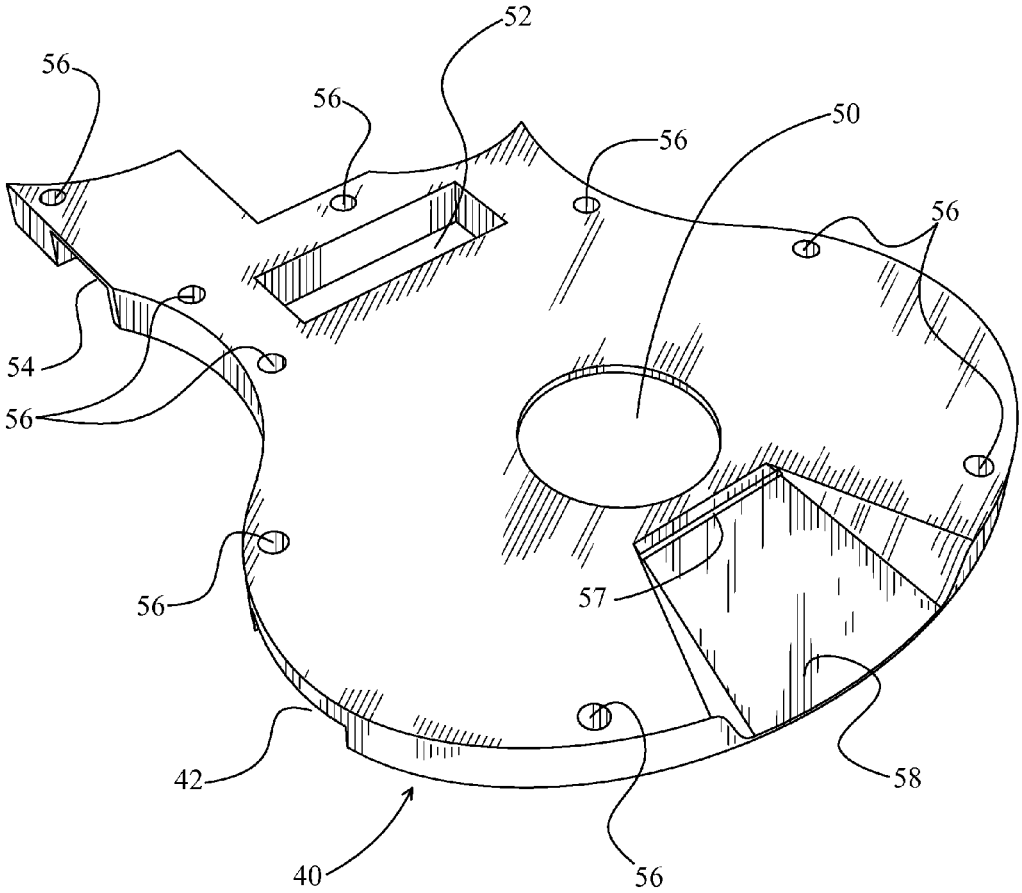
FIG. 9 is a perspective view of a top solid body section of the body portion of the stringed musical instrument of FIG. 1.
Figure 10:
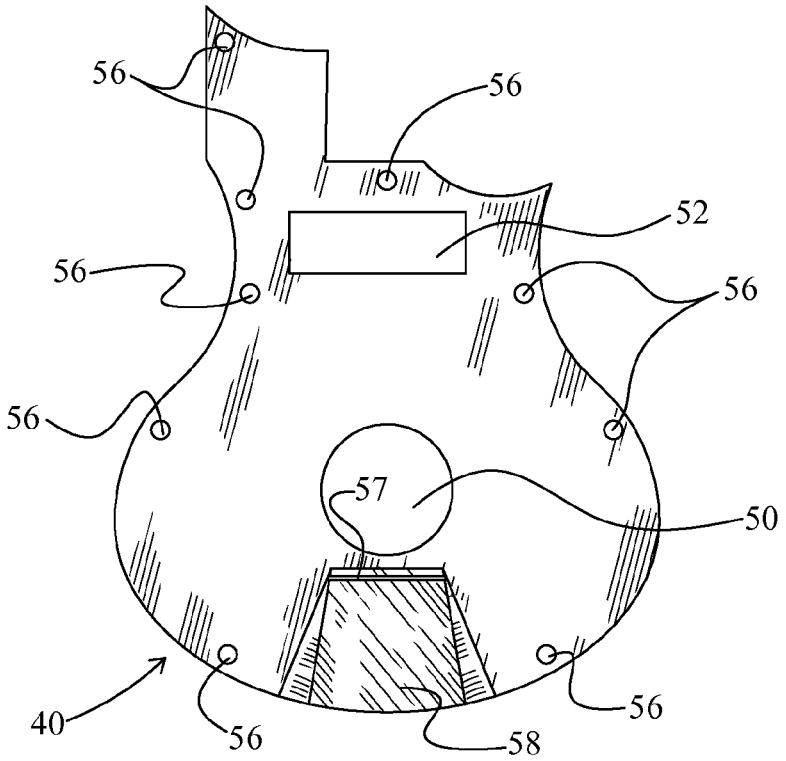
FIG. 10 is a top view of the top solid body section of the body portion of the stringed musical instrument of FIG. 1.
Figure 11:
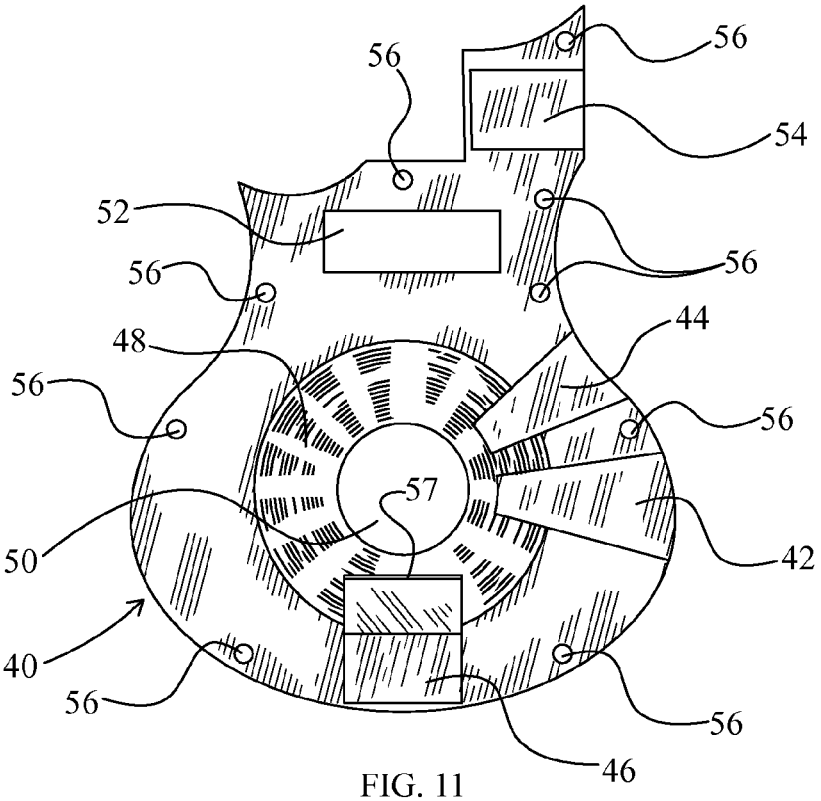
FIG. 11 is a bottom view of the top solid body section of the body portion of the stringed musical instrument of FIG. 1.

Turning initially to FIGS. 9-11, the first solid body portion 40, or solid top mounting plate 40, of the musical instrument body 10 will be explained. As shown in the perspective view of FIG. 9, the top solid body portion 40 generally comprises a circular pickup aperture 50 for receiving a cross-sectional portion of the circular pickup body portion 70, a pickup magnet aperture 52 for accommodating the pickup magnet subassembly 130, a plurality of body fastener apertures 56 for receiving the threaded insert members 108, a tailpiece slot 57 for receiving a cross-sectional portion of the upstanding top portion 86 of the tailpiece member 80, and an upper sloped recess 58 extending from the tailpiece slot 57 to the peripheral edge of the top solid body portion 40. Also, referring to the bottom plan view of FIG. 11, it can be seen that top solid body portion 40 further comprises first and second side sound ports 42, 44, a tailpiece recess 46 for accommodating the L-shaped lower portion 82 and diagonal central portion 84 of the tailpiece member 80, a frustoconical diaphragm recess 48 for accommodating the top portion of the frustoconical resonator diaphragm 60, and a potentiometer/controls side recess 54 for accommodating the potentiometer 94 and potentiometer thumb wheel control 96. As best shown in the bottom plan view of FIG. 11, each of the first and second side sound ports 42, 44 is connected to, and extends radially from the resonator diaphragm recess 48 so that sound generated by resonator assembly 61 inside the resonance chamber is capable of being radially discharged through each of the first and second side sound ports 42, 44 towards an ear of a person playing the stringed musical instrument 100 (i.e., the musician playing the stringed musical instrument 100). In the illustrated embodiment, the cross-sectional opening size of each of the first and second side sound ports 42, 44 is flared outwardly from the central resonator diaphragm recess 48 to the periphery of the first solid body portion 40 so as to amplify the sound emanating from the resonance chamber which houses the resonator diaphragm 60.

Figure 12:
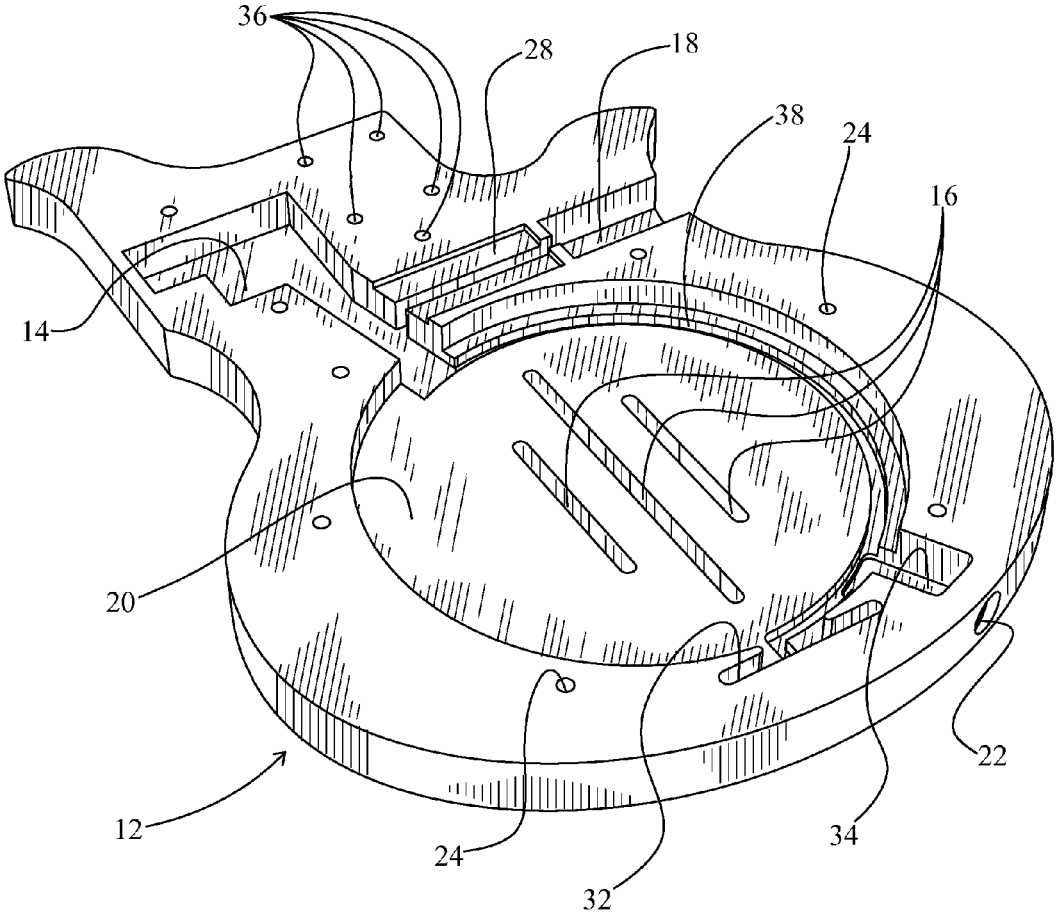
FIG. 12 is a perspective view of a bottom solid body section of the body portion of the stringed musical instrument of FIG. 1.
Figure 13:
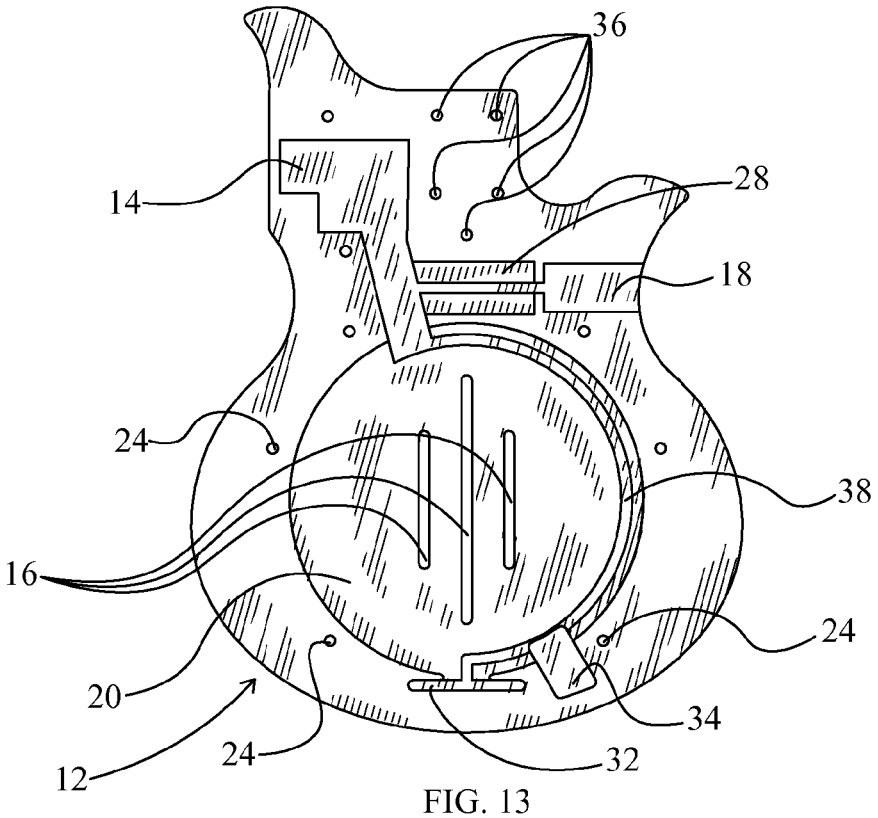
FIG. 13 is a top view of the bottom solid body section of the body portion of the stringed musical instrument of FIG. 1.
Figure 14:
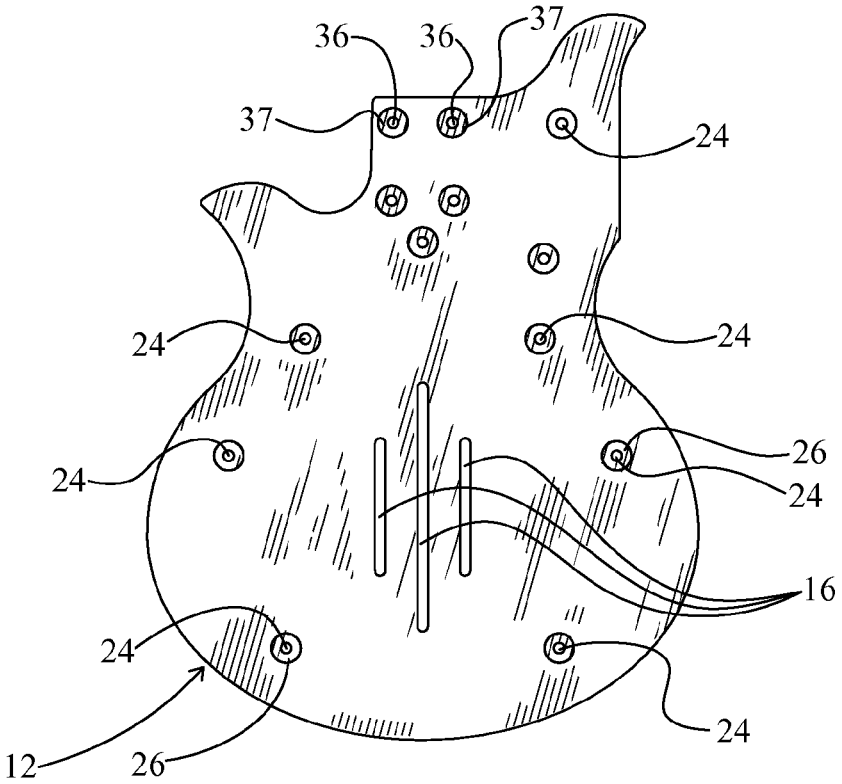
FIG. 14 is a bottom view of the bottom solid body section of the body portion of the stringed musical instrument of FIG. 1.

Next, with reference to FIGS. 12-14, the second solid body portion 12, or main body portion 12, of the musical instrument body 10 will be described. As shown in the perspective view of FIG. 12, the bottom solid body portion 12 generally comprises an electronics recess 14 for accommodating the potentiometer 94 and potentiometer thumb wheel control 96, a battery cavity 18 for receiving the battery 92, an output jack aperture 22 for accommodating the output jack 90, a plurality of body fastener apertures 24 for receiving the pan head bolts 106, a pickup magnet recess 28 for accommodating a lower portion of the pickup magnet subassembly 130, a tailpiece mounting slot 32 for receiving the downturned portion of the L-shaped lower portion 82 of the tailpiece member 80, an output jack recess 34 connected to the output jack aperture 22 for accommodating the internal portion of the output jack 90, a plurality of neck fastener apertures 36 for receiving fasteners (screws or bolts) that secure the neck 150 to the musical instrument body 10, and a semi-circular wire channel 38 for receiving one or more wires associated with the internal electronic components of the stringed musical instrument 100. In addition, as depicted in FIGS. 12 and 13, it can be seen that the bottom solid body portion 12 further comprises a plurality of spaced-apart, elongate sound ports 16 disposed through the back wall of the body portion 12 and a circular resonator diaphragm recess 20 for accommodating the bottom portion of the resonator diaphragm 60. As best shown in the perspective view of FIG. 12, each of the elongate sound ports 16 is connected to, and extends from the resonator diaphragm recess 20 so that sound generated by resonator assembly 61 inside the resonance chamber is capable of being discharged through each of the elongate sound ports 16, and out of the back wall of the musical instrument body 10. In the illustrated embodiment, a total of three (3) elongate sound ports 16 are provided through the back wall of the instrument 100 (i.e., a center sound port 16 flanked by two (2) shorter sound ports 16 on its two sides—see FIGS. 12 and 13). In addition, as depicted in FIGS. 12-14, each of the elongate sound ports 16 is disposed substantially parallel to one another. Also, referring to the bottom plan view of FIG. 14, it can be seen that each of the plurality of body fastener apertures 24 is provided with a respective counterbore portion 26 for accommodating the large heads of each pan head bolt 106 (see FIG. 4). Similarly, each of the plurality of neck fastener apertures 36 is provided with a respective counterbore portion 37 for accommodating large heads of each neck bolt or screw.

In the illustrative embodiment, the resonator diaphragm 60 is not affixed to the first solid body portion 40 or to the second solid body portion 12. Rather, the resonator diaphragm 60 is held in place within the resonance chamber (formed by the recesses 20, 48) only by means of string tension applied by one or more of the plurality of strings 170 of the stringed musical instrument 100.

Figure 6:
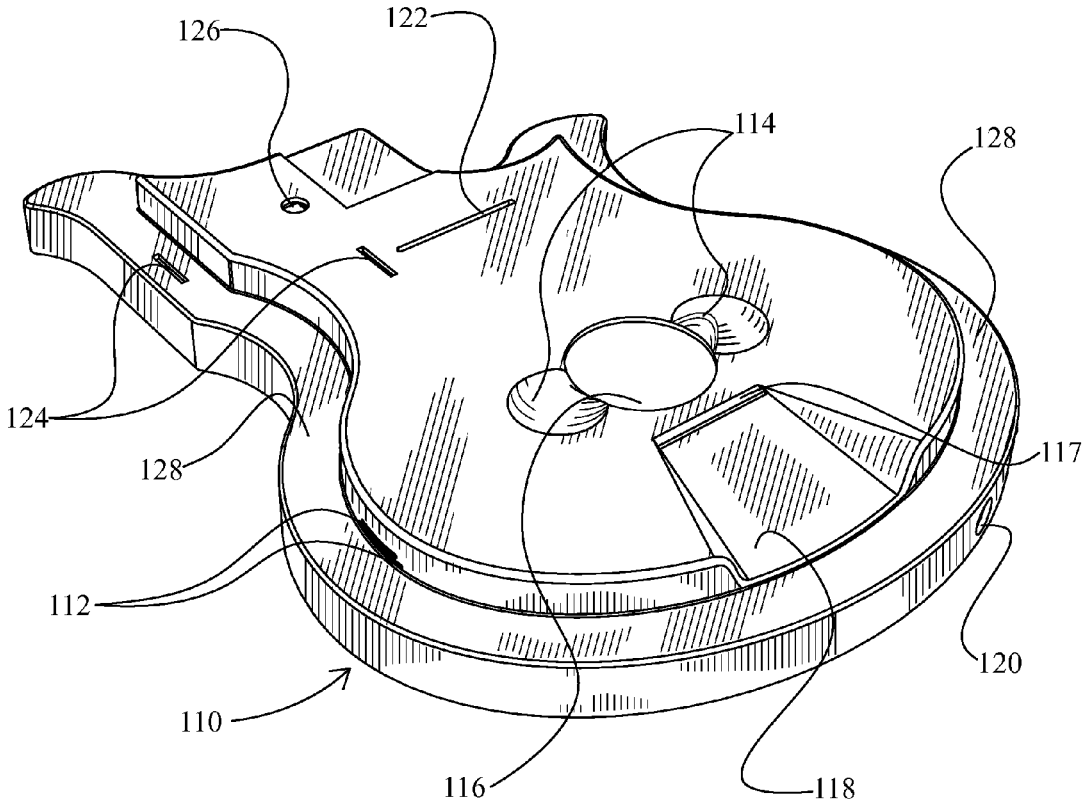
FIG. 6 is a perspective view of a top cover of the body portion of the stringed musical instrument of FIG. 1.
Figure 7:
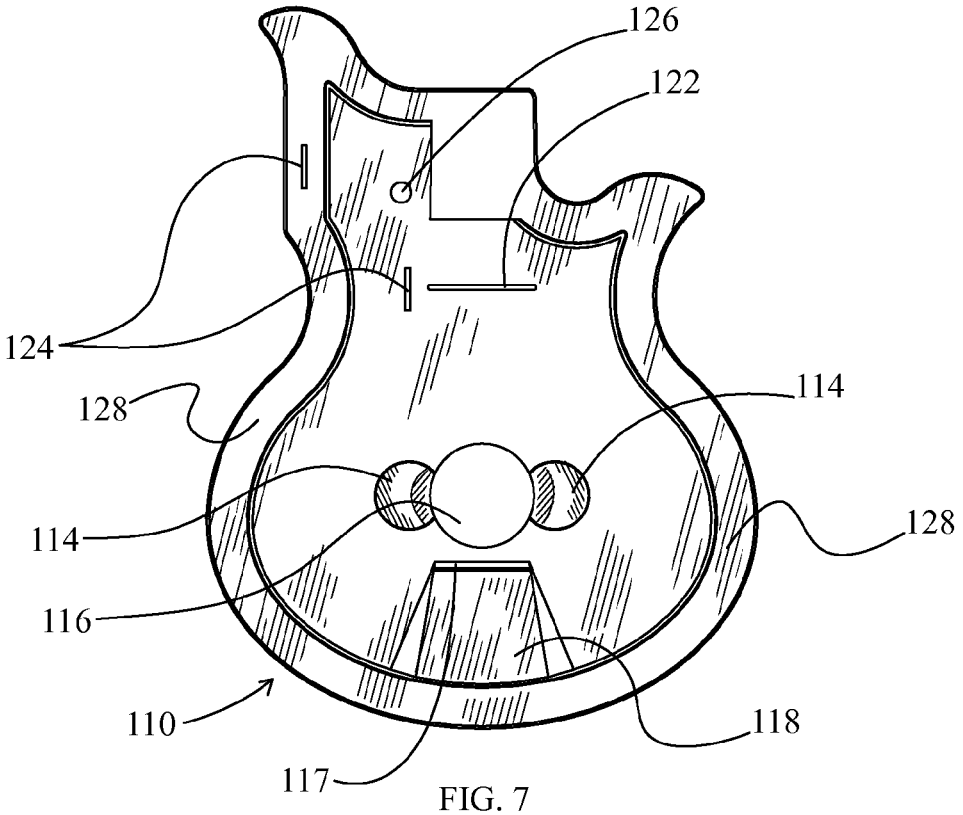
FIG. 7 is a top view of the top cover of the body portion of the stringed musical instrument of FIG. 1.
Figure 8:
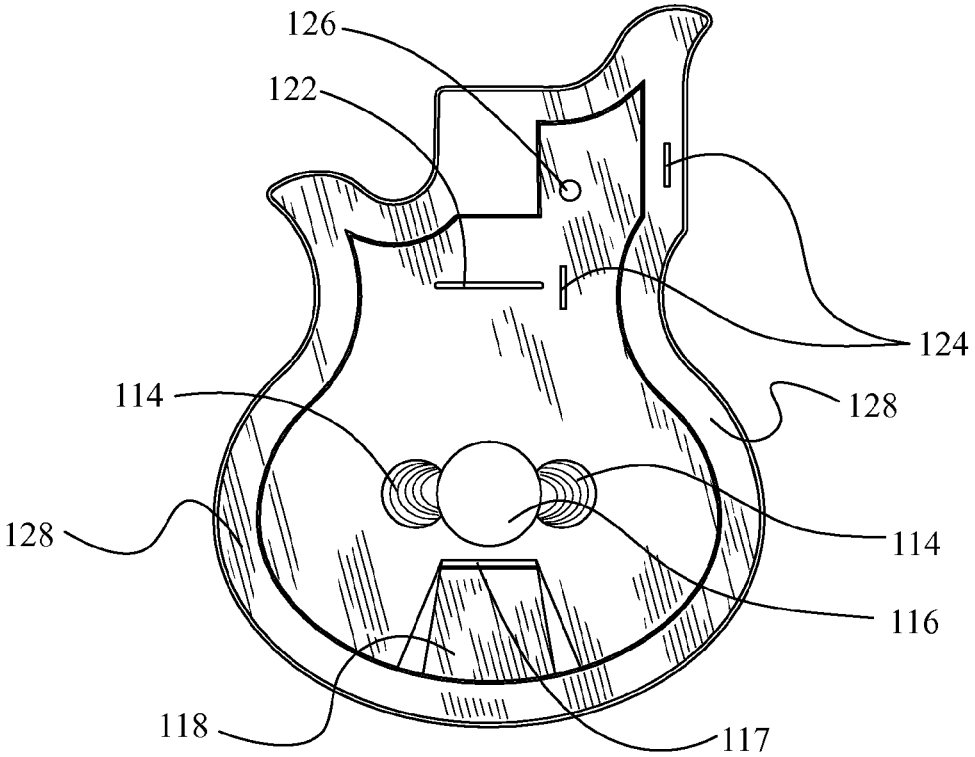
FIG. 8 is a bottom view of the top cover of the body portion of the stringed musical instrument of FIG. 1.

Turning now to FIGS. 6-8, the top cover portion 110 of the musical instrument body 10 will be explained. As shown in the perspective view of FIG. 6, the top cover portion 110 generally comprises a circular pickup aperture 116 for receiving a cross-sectional portion of the circular pickup body portion 70, a plurality of clearance bulges 114 (e.g., two (2) clearance bulges 114 disposed on opposite sides of the circular pickup aperture 116), an output jack aperture 120 for accommodating the output jack 90, an elongate pickup magnet slot 122 for receiving the blade magnet 144 of the pickup magnet subassembly 130, an elongate tailpiece slot 117 for receiving a cross-sectional portion of the upstanding top portion 86 of the tailpiece member 80, first and second elongate control slots 124 for receiving the potentiometer thumb wheel 96 and the pickup magnet thumb wheel 125, respectively. Also, referring to the perspective view of FIG. 6, it can be seen that the top cover portion 110 further comprises a plurality of elongate side sound ports 112 (e.g., two (2) elongate side sound ports 112) above the peripheral rim 128 thereof and a tailpiece ramp 118 that slopes downwardly from the tailpiece slot 117 to the peripheral rim 128 of the top cover portion 110. The plurality of elongate side sound ports 112 formed through the sidewall of the top cover portion 110 (see FIG. 6) are substantially aligned with the side sound port 42 formed in the underside of the top solid body portion 40. In addition, as depicted in the illustrative embodiment of FIG. 6, each of the elongate sound ports 112 is disposed substantially parallel to one another. The sound ports 112 allow the sound that is transported through the side sound port 42 to be discharged from the musical instrument body 10, and towards an ear of a person playing the stringed musical instrument 100 (i.e., the musician playing the stringed musical instrument 100).

Figure 5:
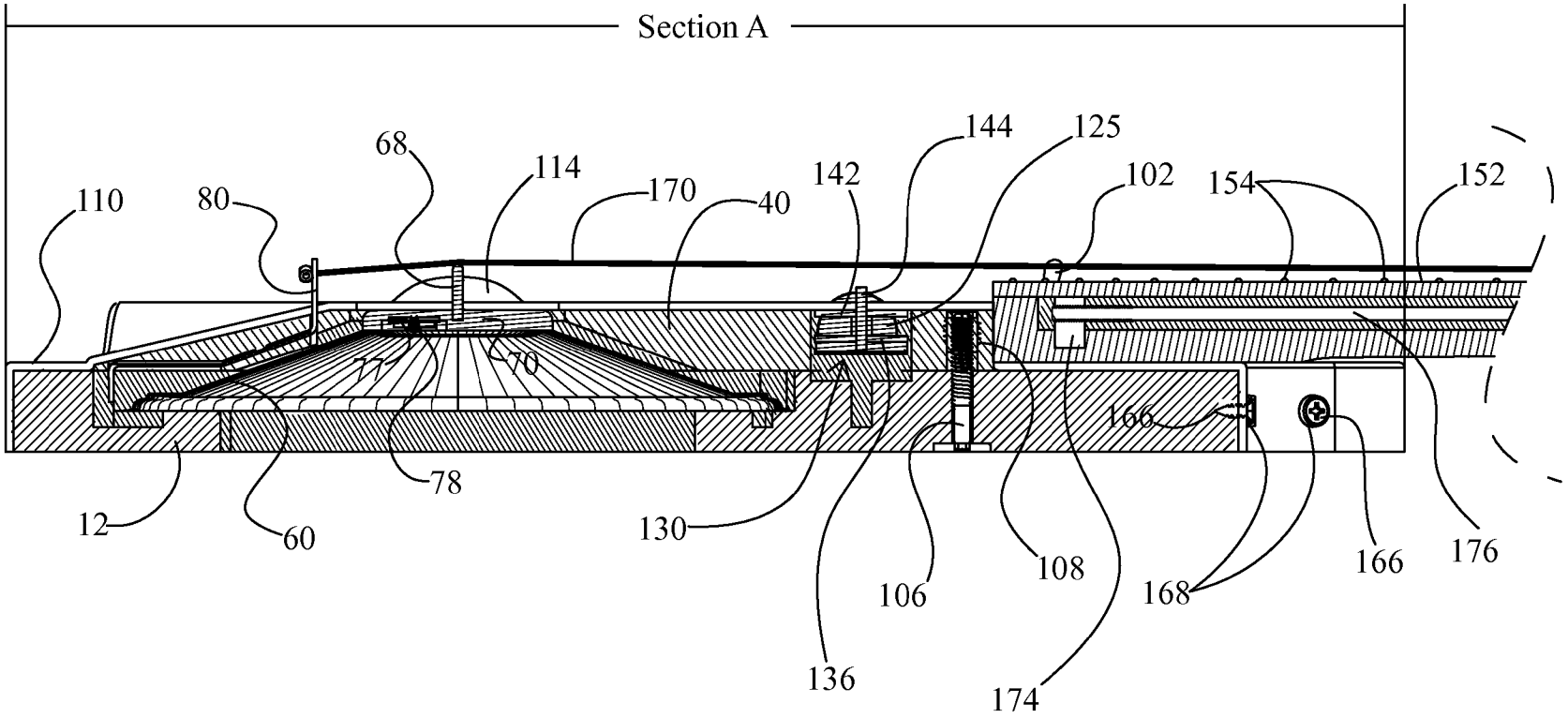
FIG. 5 is a longitudinal sectional view through the body portion of the stringed musical instrument of FIG. 1, which is cut along the cutting-plane line A-A in FIG. 3.

As best shown in FIGS. 4 and 5, in the illustrative embodiment, the top cover portion 110 fits over, and covers the first solid body portion 40 and the second solid body portion 12 so as to leave only the bottom surface of the second solid body portion 12 exposed to view (see FIG. 5). Referring to FIG. 1, it can be seen that the rim 128 of the top cover portion 110 is secured to the outer periphery of the second solid body portion 12 by a plurality of circumferentially spaced-apart fastener members 166 (e.g., screws 166) with finish washers 168 provided therearound.

In an exemplary embodiment, the first solid body portion 40 and the second solid body portion 12 each may be formed from a solid piece or solid block of wood, such as a solid piece of Alder wood. In addition, in the exemplary embodiment, the rear surface of the second solid body portion 12 may be provided with a book-matched flame Maple veneer disposed thereon (i.e., covering the rear surface of the back solid body portion 12). Also, in the exemplary embodiment, the top cover portion 110 may be formed from a suitable polymeric or plastic material, such as Duraplex® (i.e., a polycarbonate type of plexiglass). In the exemplary embodiment, the top cover portion 110 may be in the form of a molded plastic shell cover that fits over, and protects the first solid body portion 40 and the second solid body portion 12.

Figure 26:
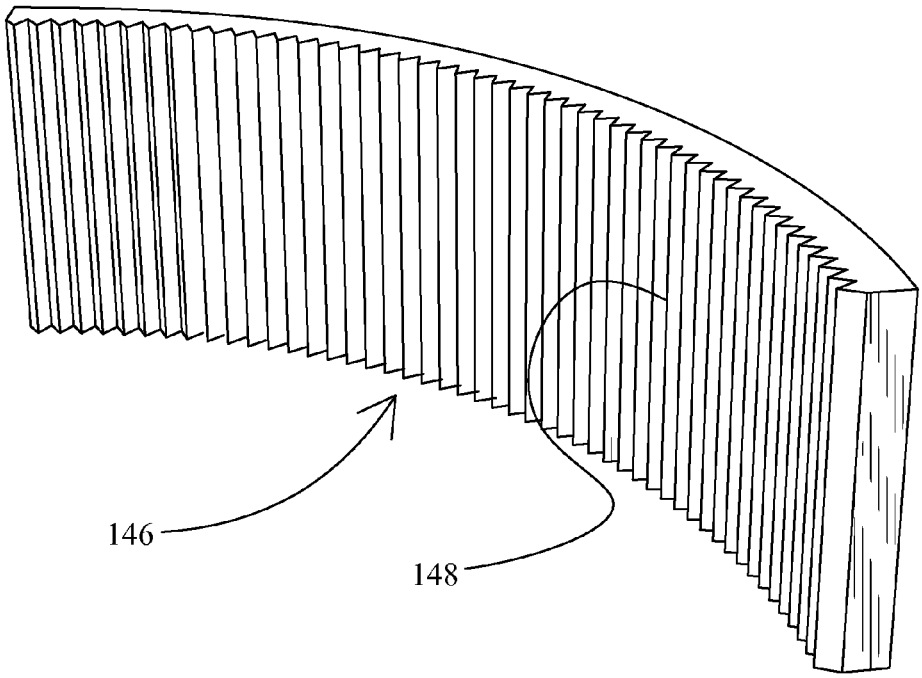
FIG. 26 is a perspective view of a leg rest/battery cover of the stringed musical instrument illustrated in FIG. 1.
Figure 27:
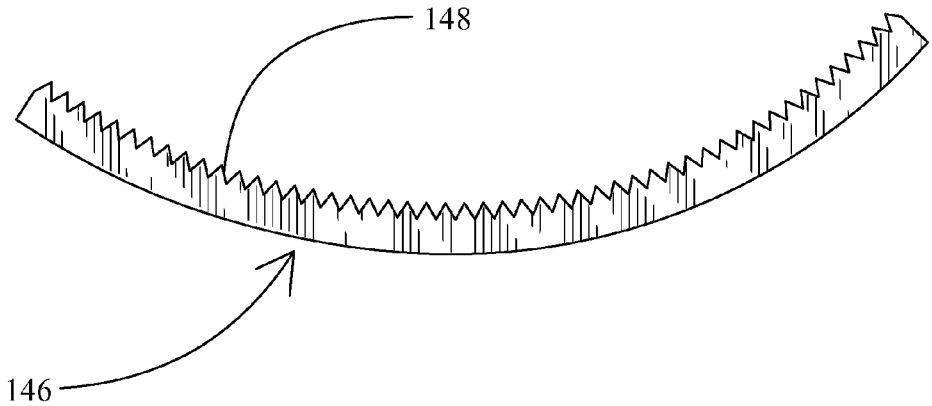
FIG. 27 is a side view of the leg rest/battery cover of the stringed musical instrument illustrated in FIG. 1.

Next, with reference again to the exploded view of FIG. 4, additional components of the stringed musical instrument 100 will be explained. As shown in this figure, an output jack 90 is received within the output jack aperture 22 of the bottom solid body portion 12, and in the output jack aperture 120 of the top cover portion 110. The output jack 90 receives an end of the instrument cable for electrically coupling the instrument 100 to an amplifier (i.e., the instrument cable plugs into the output jack 90). In the illustrative embodiment, the output jack 90 has a stereo output to route the electric biscuit-type pickup subassembly 67 to one amplifier and the electromagnetic pickup assembly 104, 130 to another amplifier, if a stereo instrument cable is used. If a standard mono instrument cable is used, the output of the pickup 67 and the pickup 104, 130 are summed to a single amplification source. Also, as shown in FIG. 4, the stringed musical instrument 100 comprises a battery 92 (i.e., a 9-volt battery 92) for powering the preamplifier that matches the outputs of the passive electromagnetic pickup assembly 104, 130 and the piezo electric pickup subassembly 67. The preamplifier boosts the piezo output of the pickup subassembly 67 to bring it close to the output of the electromagnetic pickup assembly 104, 130. The battery 92 is housed within the battery cavity or battery compartment 18 of the bottom solid body portion 12. A removable cover 146 is provided over the outside opening of the battery compartment 18 (see FIGS. 1, 2, and 4) so that a user may gain access to the battery compartment 18 to, for example, replace the battery 92 when required. The removable battery compartment cover 146 is shown in more detail in FIGS. 26 and 27. As shown in these figures, the removable battery compartment cover 146 has a semi-circular configuration to substantially conform to the curved contour of the instrument body peripheral wall. Also, it can be seen in FIGS. 26 and 27 that the battery compartment cover 146 is provided with a knurled or grooved outer surface 148 in order to facilitate the grasping and removal of the cover 146 by a user. When a musician is playing the stringed musical instrument 100, the battery compartment cover 146 also operates as a leg rest surface (i.e., the musician can at least partially support the instrument 100 while playing the instrument 100 by resting the battery compartment cover 146 against his or her leg).

Also, as shown in the exploded view of FIG. 4, the stringed musical instrument 100 also comprises a potentiometer 94 and associated potentiometer thumb wheel control 96 for controlling the volume output of the electric piezo pickup subassembly 67. The potentiometer 94 comprises a mounting plate 98 for securing the potentiometer 94 within a portion of the electronics cavity 14 of the bottom solid body portion 12. In an exemplary embodiment, the mounting plate 98 of the potentiometer 94 may be formed from brass. The stringed musical instrument 100 is additionally provided with a three-way toggle switch 102 for allowing the user to select either the output of the piezo electric pickup subassembly 67 or the output of the passive electromagnetic pickup assembly 104, 130, or the outputs of both the piezo electric pickup subassembly 67 and the passive electromagnetic pickup assembly 104, 130 (see FIGS. 1-4). Similar to the potentiometer 94 and potentiometer thumb wheel control 96, the toggle switch 102 is received with a portion of the electronics cavity 14 that is formed in the bottom solid body portion 12. The toggle switch 102 projects through the toggle switch aperture 126 in the top cover portion 110 (see FIGS. 1, 4, and 6) so that it is accessible to the musician playing the instrument 100. Referring again to FIG. 4, it can be seen that the stringed musical instrument 100 further comprises a pickup 104 and associated thumb wheel 125 and pickup magnet subassembly 130. The thumb wheel 125 is used for controlling the volume output of the electromagnetic pickup assembly, which includes the pickup 104 and pickup magnet subassembly 130. The electromagnetic pickup assembly 104, 130 senses the vibrations of the instrument strings 170, without contacting the strings 170, and outputs an electrical signal based upon the sensed vibrations of the strings 170. The pickup magnet subassembly 130 is received within the pickup magnet recess 28 of the bottom solid body portion 12. The details of the pickup magnet subassembly 130 are illustrated in FIGS. 23-25, and will be described hereinafter.

Figure 23:
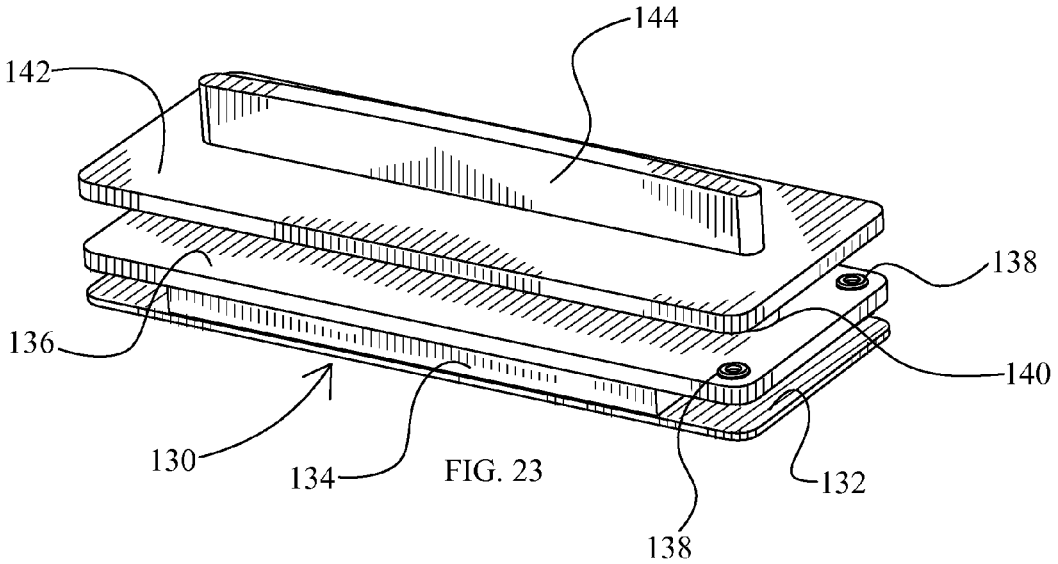
FIG. 23 is a perspective view of a pickup magnet subassembly of the stringed musical instrument illustrated in FIG. 1.
Figure 24:
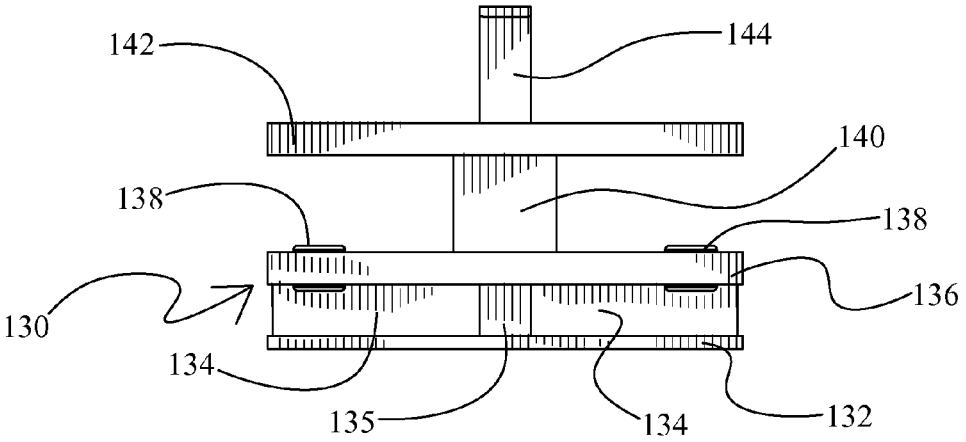
FIG. 24 is an end view of the pickup magnet subassembly of the stringed musical instrument illustrated in FIG. 1.
Figure 25:
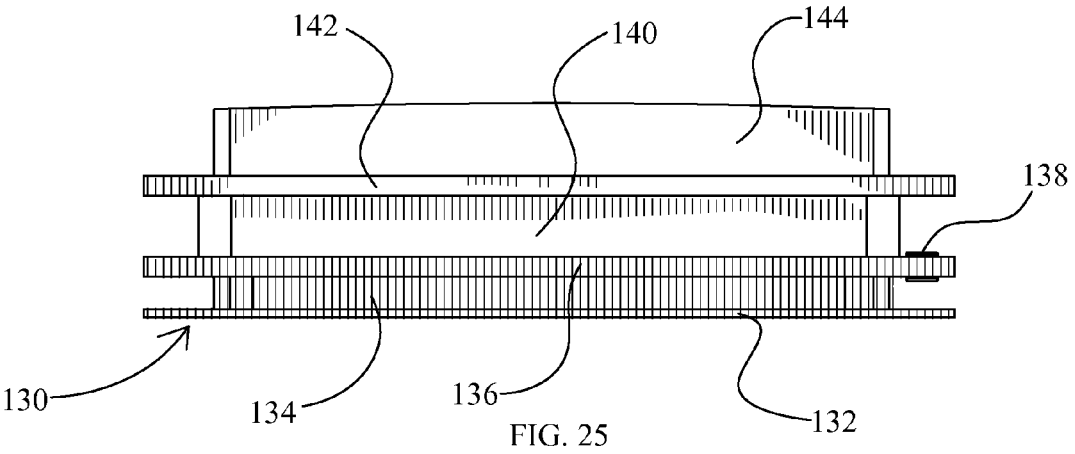
FIG. 25 is a side view of the pickup magnet subassembly of the stringed musical instrument illustrated in FIG. 1.

Turning to FIGS. 23-25, the constituent components of the illustrative pickup magnet subassembly 130 will be described. As shown in these figures, the pickup magnet subassembly 130 generally comprises a base plate 132, a bar magnet 134 and metal spacer 135 mounted on the base plate 132, a bottom bobbin plate 136 supported on the bar magnet 134 and the metal spacer 135, a bobbin plate spacer member 140 mounted on the bottom bobbin plate 136, a top bobbin plate 142 mounted on the bobbin plate spacer member 140, and a blade magnet 144 mounted on the top bobbin plate 142. The blade magnet 144 of the pickup magnet subassembly 130 projects through the elongate pickup magnet slot 122 in the top cover portion 110 of the musical instrument body 10 (see FIGS. 1 and 6). In addition, as shown in FIG. 23-25, the bottom bobbin plate 136 comprises a pair of wire eyelets 138 disposed in one end thereof. The wire eyelets 138 are spaced apart from one another, and are disposed near respective corners of the bottom bobbin plate 136. The electromagnetic pickup assembly 104, 130 reads the vibration of the nickel strings 170, and the thumbwheel 125 controls the volume output of the pickup 104. The eyelets 138 in the bottom bobbin plate 136 of the pickup magnet subassembly 130 are attachment points for the coil wire that is wrapped around the bobbin of the pickup magnet subassembly 130. One of the wire eyelets 138 is for the start of the wind of the coil wire, and the other one of the wire eyelets 138 is for the end of the wind of the coil wire.

It is readily apparent that the aforedescribed the stringed musical instrument 100 with the resonator assembly 61 offer numerous advantages. First, the stringed musical instrument 100 is capable of accurately reproducing the sound that is generated by the resonator diaphragm 60 of the resonator assembly 61 provided therein. In addition, the aforedescribed stringed musical instrument 100 with the resonator assembly 61 substantially reduces the feedback problems, which are commonly associated with conventional resonator-type stringed musical instruments. Advantageously, the stringed musical instrument 100 described above is a generally solid-body guitar that is capable of producing the sound of an acoustic guitar. In the illustrative embodiment, the stringed musical instrument 100 utilizes both the pickup 67 with the elongate piezo-film transducer portion 72 and the electromagnetic pickup assembly 104, 130 to produce a unique sound that cannot be produced by conventional instruments. The solid-body construction of the stringed musical instrument 100 prevents the feedback problems associated with conventional resonator-type stringed musical instruments because the resonator diaphragm 60 of the instrument 100 is protectively housed within the resonance chamber (see FIG. 5) formed by the solid body portions 12, 40. Thus, advantageously, the stringed musical instrument 100 can even be played at high volume levels without being subject to feedback problems. In particular, the stringed musical instrument 100 described herein is capable of reproducing the sound of an acoustic resonator guitar loud enough to use with an amplified band. Unlike the conventional resonator-type stringed musical instruments, which only cover the front surface of the diaphragm using a thin metal cover plate, the resonator diaphragm 60 of the inventive stringed musical instrument 100 is well protected within the solid wall resonance chamber. Advantageously, the aforedescribed stringed musical instrument 100 combines the acoustic sound of an acoustic resonator, in combination with the magnetic pickup 104, 130 in a protective two-piece solid body design to reduce feedback when amplified.

While the stringed musical instrument 100 described above is generally in the form of a resonator electric guitar, it is to be understood that the inventive resonator assembly 61 described above can be utilized with other types of stringed musical instruments as well. For example, in addition to being used in a resonator electric guitar, the resonator assembly 61 may also be used with resonator banjos, resonator mandolins and resonator ukuleles.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A stringed musical instrument comprising, in combination:

a musical instrument body;

a neck having a first end portion and a second end portion, said second end portion of said neck being coupled to said musical instrument body;

a plurality of strings extending from said first end portion of said neck to said musical instrument body; and a resonator assembly disposed in said musical instrument body, said resonator assembly including a resonator diaphragm and a pickup subassembly operatively coupled to said resonator diaphragm, said resonator diaphragm comprising a frustoconical body portion having a tapered sidewall, said pickup subassembly comprising a pickup body portion and an elongate piezo-film portion operatively coupled to said pickup body portion, said elongate piezo-film portion having a first end and a second end, said first end of said elongate piezo-film portion being attached to said pickup body portion and said second end of said elongate piezo-film portion being attached to a side of said resonator diaphragm, said side of said resonator diaphragm to which said second end of said elongate piezo-film portion is attached comprising said tapered sidewall of said frustoconical body portion.

2. The stringed musical instrument according to claim 1, wherein said elongate piezo-film portion is attached to said tapered sidewall of said frustoconical body portion of said resonator diaphragm by means of metallic tape.

3. The stringed musical instrument according to claim 1, wherein said frustoconical body portion of said resonator diaphragm is formed from aluminum.

4. The stringed musical instrument according to claim 1, wherein said musical instrument body comprises at least one solid body portion having a plurality of recesses formed therein for receiving internal components of said stringed musical instrument, at least one of said plurality of recesses formed in said at least one solid body portion being configured to receive said resonator diaphragm.

5. The stringed musical instrument according to claim 4, wherein said at least one solid body portion of said musical instrument body comprises a first solid body portion forming a top portion of said musical instrument body and a second solid body portion forming a bottom portion of said musical instrument body, said first and second solid body portions of said musical instrument body configured to be attached to one another by means of a plurality of fasteners, and said first and second solid body portions together forming a resonance chamber for housing said resonator diaphragm.

6. The stringed musical instrument according to claim 5, wherein said second solid body portion, which forms said bottom portion of said musical instrument body, comprises one or more elongate sound ports disposed therein for allowing sound generated within said resonance chamber of said musical instrument body to be discharged from said stringed musical instrument.

7. The stringed musical instrument according to claim 5, wherein said musical instrument body comprises a top cover portion, said top cover portion configured to fit over said first solid body portion and said second solid body portion.

8. The stringed musical instrument according to claim 5, wherein said first solid body portion, which forms said top portion of said musical instrument body, comprises one or more radially extending sound ports formed therein, said one or more radially extending sound ports being connected to said resonance chamber of said musical instrument body so as to allow sound generated within said resonance chamber of said musical instrument body to be discharged from said stringed musical instrument.

9. The stringed musical instrument according to claim 8, wherein a cross-sectional opening size of each of said one or more radially extending sound ports is flared outwardly from said resonance chamber to a periphery of said first solid body portion so as to amplify the sound emanating from said resonance chamber.

10. The stringed musical instrument according to claim 5, wherein said resonator diaphragm is not affixed to said first solid body portion or to said second solid body portion, said resonator diaphragm being held in place within said resonance chamber only by means of string tension applied by one or more of said plurality of strings of said stringed musical instrument.

11. The stringed musical instrument according to claim 1, wherein said frustoconical body portion of said resonator diaphragm is formed from aluminum.

12. A stringed musical instrument comprising, in combination:

a musical instrument body, said musical instrument body including at least one solid body portion having a plurality of recesses formed therein for receiving internal components of said stringed musical instrument, said at least one solid body portion of said musical instrument body further including a first solid body portion forming a top portion of said musical instrument body and a second solid body portion forming a bottom portion of said musical instrument body, said first and second solid body portions of said musical instrument body configured to be attached to one another by means of a plurality of fasteners;

a neck having a first end portion and a second end portion, said second end portion of said neck being coupled to said musical instrument body;

a plurality of strings extending from said first end portion of said neck to said musical instrument body; and a resonator assembly disposed in said musical instrument body, said resonator assembly including a resonator diaphragm and a pickup subassembly operatively coupled to said resonator diaphragm, said pickup subassembly comprising a pickup body portion and an elongate piezo-film portion operatively coupled to said pickup body portion, a part of said elongate piezo-film portion being attached to a side of said resonator diaphragm by means of adhesive tape, at least one of said plurality of recesses formed in said at least one solid body portion being configured to receive said resonator diaphragm, and said first and second solid body portions together forming a resonance chamber for housing said resonator diaphragm.

13. The stringed musical instrument according to claim 12, wherein said pickup body portion is circular in shape, and wherein said stringed musical instrument further comprises a saddle member attached to a top portion of said pickup body portion, said saddle member extending transversely across said top portion of said pickup body portion.

14. The stringed musical instrument according to claim 12, wherein said resonator diaphragm comprises a frustoconical body portion having a tapered sidewall, said frustoconical body portion of said resonator diaphragm being formed from aluminum.

15. A stringed musical instrument comprising, in combination:

a musical instrument body, said musical instrument body including at least one solid body portion, said at least one solid body portion comprising a resonator diaphragm recess and one or more sound ports formed therein, said one or more sound ports being connected to, and extending radially from said resonator diaphragm recess;

a neck having a first end portion and a second end portion, said second end portion of said neck being coupled to said musical instrument body;

a plurality of strings extending from said first end portion of said neck to said musical instrument body; and a resonator assembly disposed in said musical instrument body, said resonator assembly including a resonator diaphragm and a pickup subassembly operatively coupled to said resonator diaphragm, said resonator diaphragm comprising a frustoconical body portion having a tapered sidewall, at least a portion of said resonator diaphragm being received within said resonator diaphragm recess in said at least one solid body portion so that sound generated by resonator assembly is capable of being radially discharged through said one or more sound ports towards an ear of a person playing said stringed musical instrument, said pickup subassembly comprising a pickup body portion and an elongate piezo-film portion operatively coupled to said pickup body portion, said elongate piezo-film portion having a first end and a second end, said first end of said elongate piezo-film portion being attached to said pickup body portion and said second end of said elongate piezo-film portion being attached to a side of said resonator diaphragm, said side of said resonator diaphragm to which said second end of said elongate piezo-film portion is attached comprising said tapered sidewall of said frustoconical body portion.

16. The stringed musical instrument according to claim 15, wherein said musical instrument body further comprises a top cover portion, said top cover portion configured to fit over said at least one solid body portion of said musical instrument body, said top cover portion comprising one or more sound ports formed therethrough, at least one of said one or more sound ports of said top cover portion being substantially aligned with said one or more sound ports of said at least one solid body portion.

17. The stringed musical instrument according to claim 15, wherein said at least one solid body portion of said musical instrument body comprises a first solid body portion forming a top portion of said musical instrument body and a second solid body portion forming a bottom portion of said musical instrument body, said first and second solid body portions together forming a resonance chamber for housing said resonator diaphragm, said resonator diaphragm recess and said one or more sound ports being formed in said first solid body portion of said musical instrument body, and said resonator diaphragm recess in said first solid body portion forming a portion of said resonance chamber.

18. The stringed musical instrument according to claim 17, wherein said second solid body portion, which forms said bottom portion of said musical instrument body, comprises one or more elongate sound ports disposed therein for allowing sound generated within said resonance chamber of said musical instrument body to be discharged through a back side of said stringed musical instrument.

19. The stringed musical instrument according to claim 17, wherein said resonator diaphragm is not affixed to said first solid body portion or to said second solid body portion, said resonator diaphragm being held in place within said resonance chamber only by means of string tension applied by one or more of said plurality of strings of said stringed musical instrument.

20. The stringed musical instrument according to claim 15, wherein said frustoconical body portion of said resonator diaphragm is formed from aluminum.

* * * * *